US005117567A

United States Patent [19]

Berger

[11] Patent Number: 5,117,567

[45] Date of Patent: Jun. 2, 1992

[54] SHOE WITH FLEXIBLE UPPER MATERIAL PROVIDED WITH A CLOSING DEVICE

[75] Inventor: Christoph Berger, Egloffstein, Fed. Rep. of Germany

[73] Assignee: Puma AG Rudolf Dassler Sport, Herzogenaurach, Fed. Rep. of Germany

[21] Appl. No.: 532,278

[22] Filed: Jun. 4, 1990

[30] Foreign Application Priority Data

| | | | |
|---|---|---|---|
| Jun. 3, 1989 | [DE] | Fed. Rep. of Germany | 8906840[U] |
| Oct. 28, 1989 | [DE] | Fed. Rep. of Germany | 8912788[U] |
| Feb. 13, 1990 | [DE] | Fed. Rep. of Germany | 9001645[U] |
| May 15, 1990 | [DE] | Fed. Rep. of Germany | 9005496[U] |

[51] Int. Cl.[5] ..... A43B 11/00

[52] U.S. Cl. ..... 36/50; 36/54

[58] Field of Search ..... 36/50, 51, 54; 24/712.1, 712.5, 712.9, 713

[56] References Cited

U.S. PATENT DOCUMENTS

| | | | |
|---|---|---|---|
| 61,487 | 1/1867 | Vollschwartz | 24/713 |
| 1,408,563 | 3/1922 | Conger | 36/50 |
| 1,489,126 | 4/1924 | Jansizian | 36/50 |
| 1,494,653 | 5/1924 | Walters | 36/50 |
| 3,738,027 | 6/1973 | Schoch | 36/50 |
| 3,808,644 | 5/1974 | Schoch | 36/50 |
| 4,551,932 | 11/1985 | Schoch | 36/50 |
| 4,670,949 | 6/1987 | Autry | 36/50 |
| 4,817,303 | 4/1989 | Selbiger | 36/50 |
| 4,870,761 | 10/1989 | Tracy | 36/51 |
| 4,999,889 | 3/1991 | LeCouturer | 24/713.2 |
| 5,042,177 | 8/1991 | Schoch | 36/117 |

FOREIGN PATENT DOCUMENTS

| | | | |
|---|---|---|---|
| 7043154183 | 11/1970 | Fed. Rep. of Germany . | |
| 89796 | 5/1972 | Fed. Rep. of Germany . | |
| 2900077 | 7/1980 | Fed. Rep. of Germany | 36/50 |
| 3626837A1 | 2/1988 | Fed. Rep. of Germany . | |
| 3813470 | 11/1989 | Fed. Rep. of Germany | 36/50 |
| 1374110 | 8/1964 | France | 24/712.1 |

*Primary Examiner*—Steven N. Meyers

*Attorney, Agent, or Firm*—Sixbey, Friedman, Leedom & Ferguson

[57] ABSTRACT

A shoe provided with a central closing device, especially a sport, leisure or rehabilitation shoe, with an upper formed of flexible upper materials, and with an instep shield which covers the instep. The instep shield is designed so that it can be fastened to the side parts of the shoe on both sides of the shoe upper, in a manner making is possible to tighten the instep shield and the side parts of the shoe upper over the entire closing area in a simple way and with as uniform a closing or tightening force as possible to guarantee as uniform a pressure distribution as possible along the entire throat area of the shoe. This is achieved by the instep shield being connected, on each side of its end that is directed toward a toe of the upper, to a closing flap made of a springy elastic material, with each closing flap being connected to a respective side part of the upper and running along the length of the instep shield. Furthermore, a closing device is used which includes a central tigthening system having at least one tightening lock and at least one tightening element for moving the closing flaps, and the side parts of the upper to which they are connected, with respect to the instep shield. The at least one tightening element runs between the closing flaps and the instep shield in a crossing-free manner, at least at upper and lower parts of the instep shield.

85 Claims, 12 Drawing Sheets

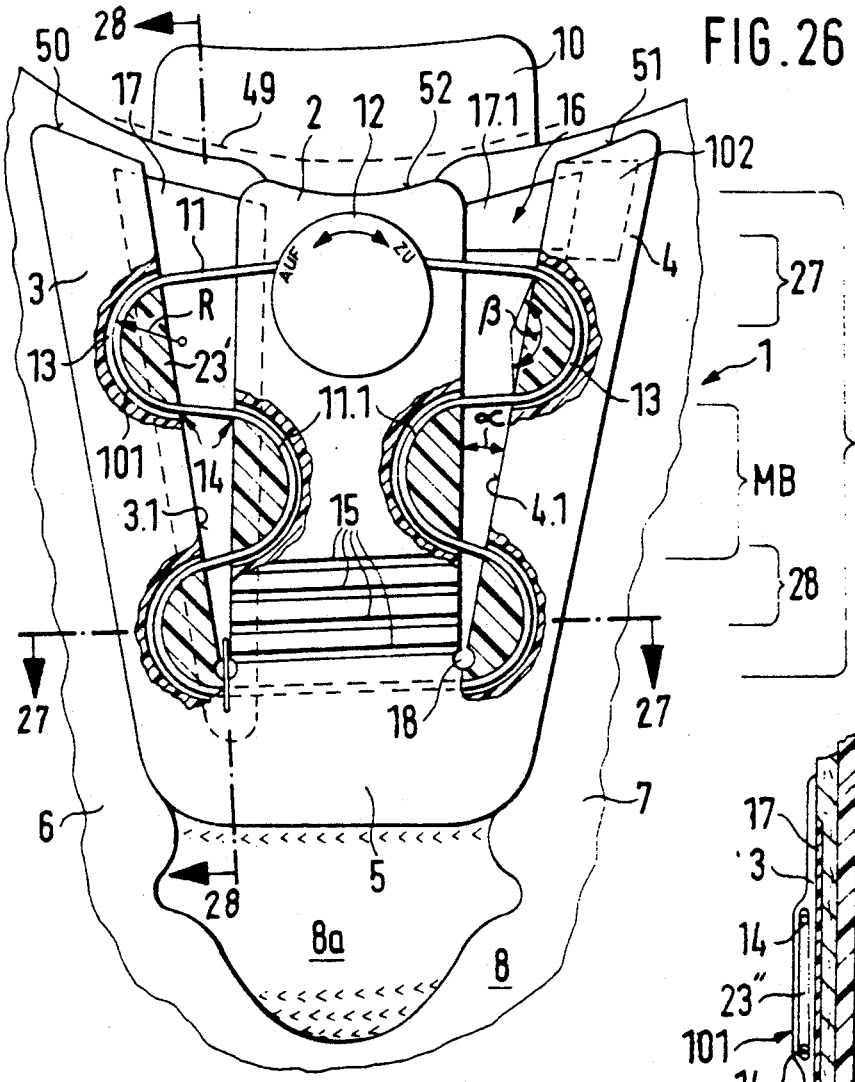
FIG.26
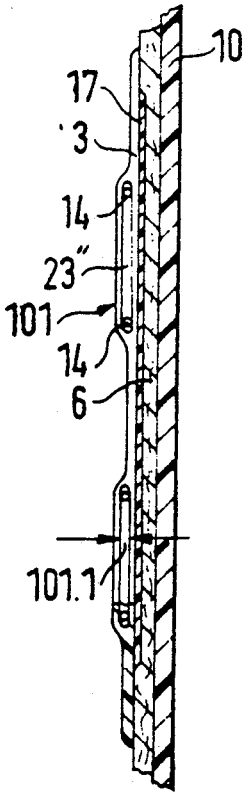
FIG.28
FIG.27
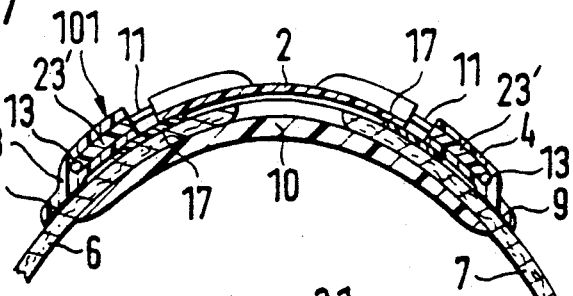
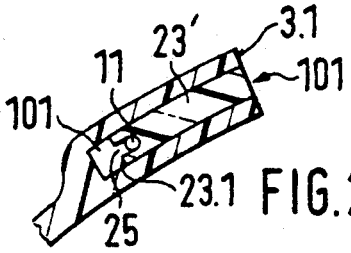
FIG.27A

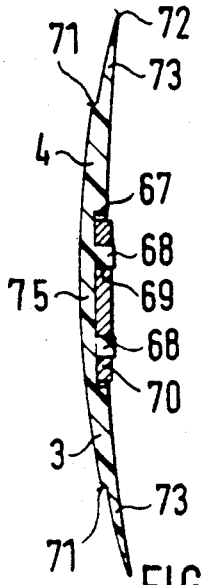
FIG.33
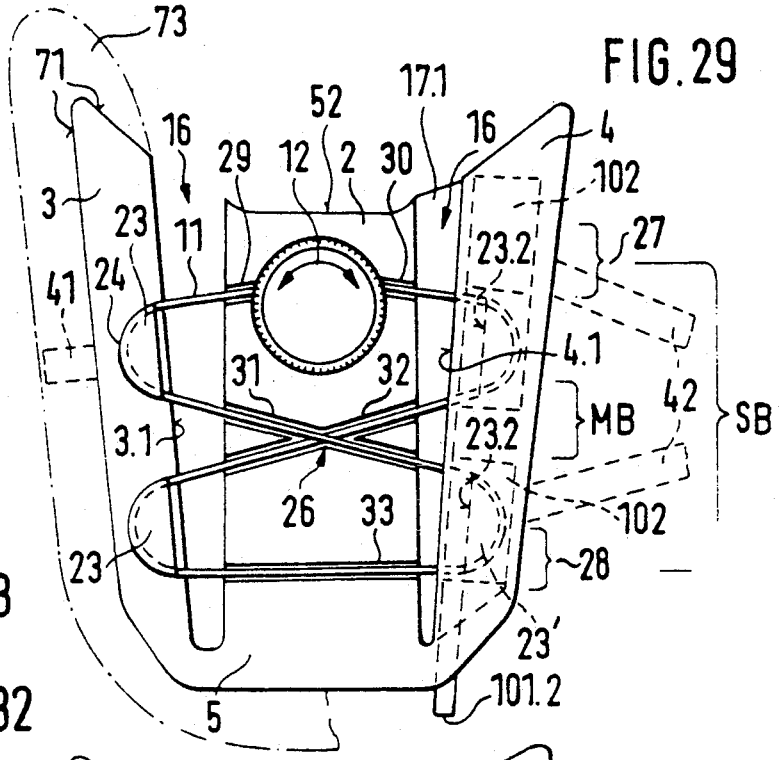
FIG.29
FIG.32
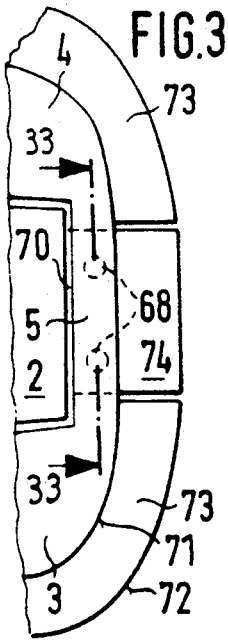
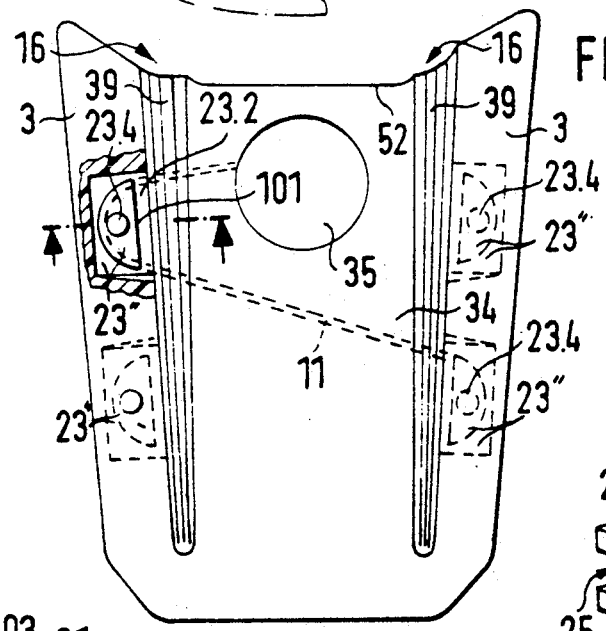
FIG.30
FIG.30A
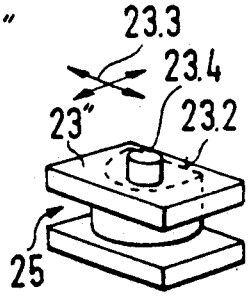
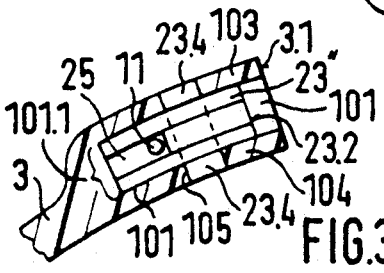
FIG.30B
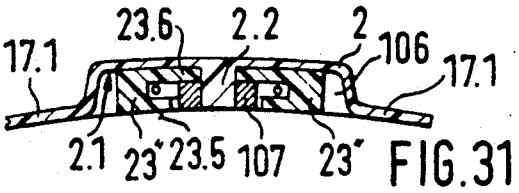
FIG.31

SHOE WITH FLEXIBLE UPPER MATERIAL PROVIDED WITH A CLOSING DEVICE

BACKGROUND OF THE INVENTION

This invention relates to a shoe provided with a closing device, especially a sport, leisure or rehabilitation shoe, with an upper material that is flexible to tensile stresses in the closing area, or with several flexible upper materials, such as natural or artificial leather, fiber, and fabric, as well as with or without trimmings, and which has an instep shield covering an instep area that can be fastened to side parts of the upper at both sides of the shoe.

A sport shoe, namely a soccer shoe, with a closure of this type is known from GDR Patent 89 796. In this previously known soccer shoe, each side of the instep shield can be fastened by a lace to a tab that is provided at each side of the shoe on side parts of the shoe upper. The lace is threaded through eyelets in the instep shield and in the side tabs, and is tied behind the heel part of the soccer shoe. With such a lacing arrangement, the point pressures which occur in tightening a lace of the usual type that runs over the instep are reduced. Thus, the circulation of blood in the instep area is no longer so greatly impaired.

However, with such a closure, in tightening or fastening the lace on both sides of the instep shield, a uniform lacing, from the lowest to the highest eyelet, is not possible. This is caused by the fact that the tensile stress from the free end of the lace to the last eyelet quickly decreases due to the high friction forces which are produced. In particular, a high friction locking between the instep shield and the side tabs, on the one hand, and the lace, on the other hand, is produced on the respective support, and the laces are squeezed in between by the closing pressure of the instep shield and side tabs as they are tightened.

The use of central tightening locks as locking devices are known for ski boots, which have plastic shell-shaped closing flaps that are, essentially, inflexible under tensile stresses; see, for example, German Auslegeschrift 20 46 890 and U.S. Pat. No. 3,738,027 which is based thereon. However, this type of closure device for inflexible alpine ski boots extends on only a short section of the closing flaps of the boot, and cannot be used on a shoe having an upper that is formed of materials that are flexible under tensile stresses (i.e., they tend to stretch) in the closing area.

A corresponding situation also applies relative to the previously known, central lock for alpine ski boots according to German Auslegeschrift 22 13 720 and the noted U.S. Pat. No. 3,808,644, in which rope loops are used as a tensioning element. Another central lock with rope loops for alpine ski boots is known from German Auslegeschrift 36 26 837. The previously known central locks cannot be produced as a prefabricated, pretested and premounted unit, so that the central locks of these alpine ski boots must be adjusted and matched to one another in each case.

SUMMARY OF THE INVENTION

Therefore, it is a primary object of this invention to achieve an improvement over the previously known, instep area double lacing which makes it possible to tighten the instep shield and the side parts of the shoe upper over the entire closing area in a simple way and with as uniform a closing or tightening force as possible to guarantee as uniform pressure distribution as possible along the entire closing area, as well as along the area of the arch of the instep of the foot, i.e., crosswise to the shoe longitudinal direction.

This object is achieved, in preferred embodiments of the invention, by a respective closing flap made of an elastic or springy elastic material being relatively displaceably disposed at each side of the instep shield. Each closing flap runs in a direction away from the toe area of the upper toward the ankle opening of the upper, essentially parallel or at a small, acute angle relative to the instep shield, and they may be flexibly connected to the instep shield or may be spaced separate parts. The instep shield is provided with a central tightening lock, by which the closing flaps (and side parts of the shoe upper that are permanently connected to them) are drawn toward the instep shield by at least one tightening element. The tightening element or elements may connect the closing flaps to the instep shield at least at upper and lower parts of the instep shield in a crossing-free manner (i.e., portions of the tightening element(s) do not criss-cross over one another).

By this invention it is guaranteed that the mutual position of tightening element-guides of the instep shield or of the closing flaps is precisely established and optimized, and that the tightening element or elements is/are not squeezed by the closing pressure of the instep shield and the closing flaps, namely, at points and/or in portions of the closing area. Furthermore, a continuous (i.e., infinitely variable) adjustment of the fastening is possible to the greatest extent in a simple way by the central tightening lock.

Also, the closing device, according to the invention, can be prefabricated, pretested and fastened, as a reliably operating closing unit, on the corresponding shoes, especially sport, leisure or rehabilitation shoes.

The use of separate components for the instep shield, on the one hand, and for the closing flaps, on the other hand, especially, provides the further advantage that a high longitudinal flexibility in the instep area is retained, and a good adaptability of these parts of the central closing device crosswise over the instep area is guaranteed. This also applies to other embodiments that are designed with hinge-like or joint-like connection points or connection areas between the instep shield and the closing flaps.

While, as noted, a crossing-free arrangement of the tightening element(s) can be provided, depending on the height of the shoe upper, it is also possible to have one or more crossings without producing friction related problems. That is, by a special configuration of intersecting grooves, even in such embodiments of this invention, a low friction or frictionless crossing of the tightening element or elements is guaranteed, since tightening element portions do not lie on one another at any point. Thus, an easy fastening and loosening of the closing device is possible and, moreover, wear is completely prevented by avoiding a high pressure being applied on the tightening element or elements at their crossing point.

A relatively stable closing edge is produced by the use of springy elastic material for the closing device on the shoe opening at the end of the closing area. In a further development of the invention, this closing edge can be used, by a special configuration of the tongue end part, to stabilize or fix the position of the tongue relative to the closing device and, moreover, make possible a specific guiding of the opening and closing upper end parts of the shoe upper.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 26 is a top view similar to FIG. 1 of the instep area of a sport shoe with another embodiment of the closing device according to the invention;

FIG. 27 is a cross-sectional view taken along line 27—27 of FIG. 26;

FIG. 27A is an enlarged view of the left closing flap of FIG. 27;

FIG. 28 is a view taken along section line 28—28 of FIG. 26;

FIG. 29 is a top view of an instep shield with closing flaps and with an intersecting tightening element;

FIG. 30 is a partially broken-away top view of a structural unit of an instep shield and closing flap with a covering membrane provided between these parts;

FIG. 30A is a perspective view of a guide element used in the embodiment according to FIG. 30;

FIG. 30B is a partial view, similar to that represented in FIG. 27A;

FIG. 31 is a cross section through an instep shield with guide elements in a depression of this instep shield;

FIG. 32 is a top view of a lower section of the closing device near the shoe toe;

FIG. 33 is a sectional view taken along section line 33—33 of FIG. 32.

DETAILED DESCRIPTION OF THE PREFERRED EMBODIMENTS

Figure 1:
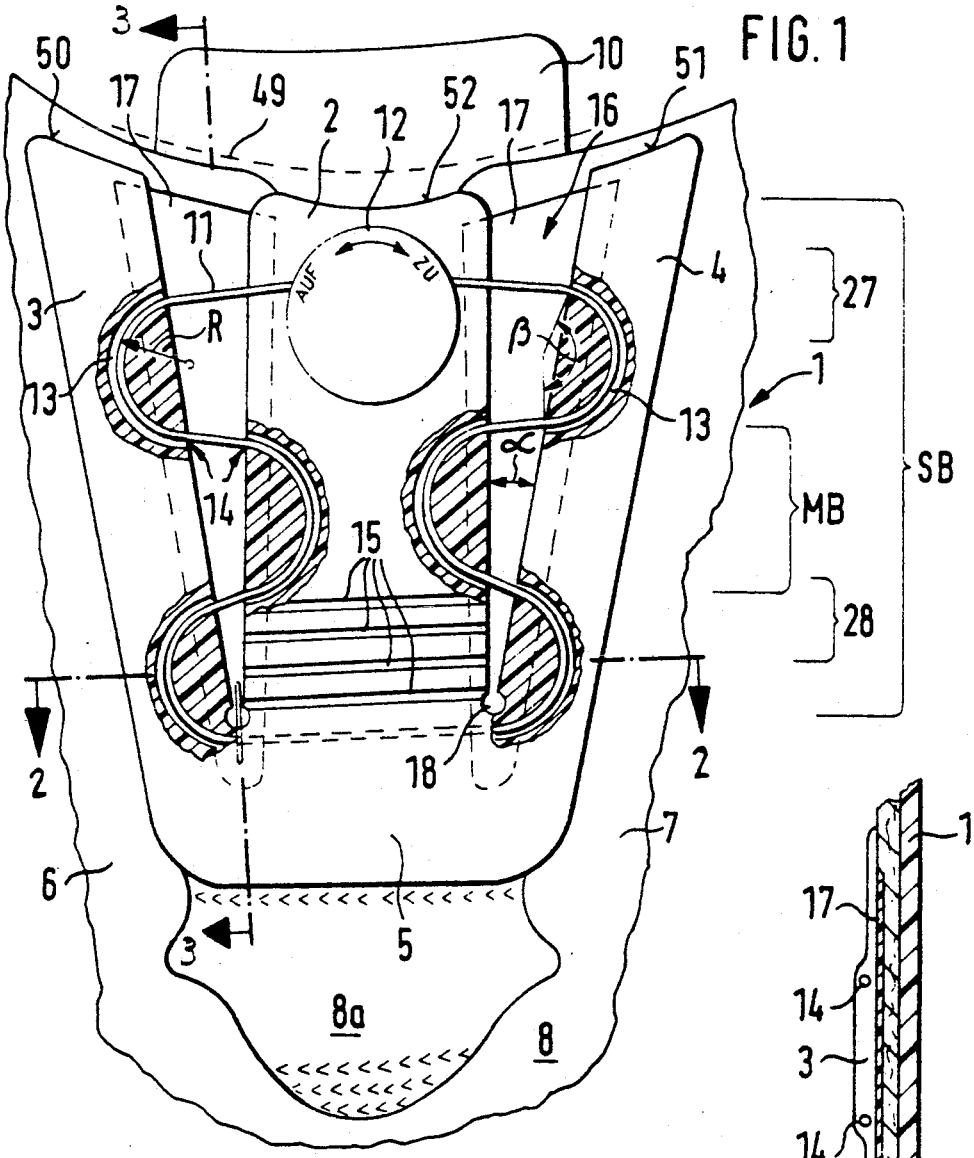
FIG. 1 is a top plan view of an instep area section of a sport shoe having a first embodiment of a locking device according to the invention.

A section of a sport shoe, namely its instep area, is identified, generally, by reference numeral 1 in FIG. 1. On this instep area, an instep shield 2 is provided which forms a structural unit with two side closing flaps 3 and 4. That is, the closing flaps 3, 4 are formed on a toe-directed end 5 of instep shield 2, and from there run substantially parallel or inclined at a small acute angle of about 5° to 15° relative to instep shield 2. Closing flaps 3, 4 can also be fastened to end 5 of instep shield 2 in a jointed manner, for example, by a hinge or, preferably, by a spring joint.

Figure 2:
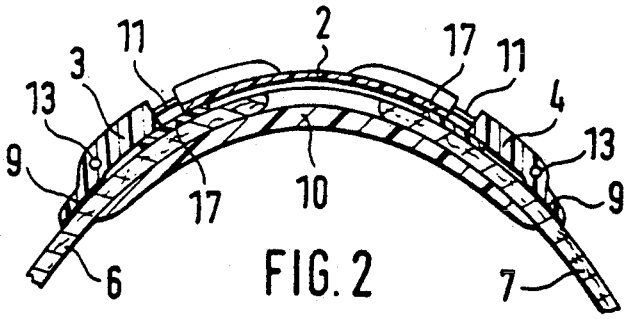
FIG. 2 is a sectional view taken along line 2—2 of FIG. 1.

Closing flap 3 is connected permanently to one side 6 and closing flap 4 to the other side 7 of the upper material or shoe upper 8 of this sport shoe. For example, they may be sewn and/or cemented together. As an example of an embodiment illustrating the use of cementing, FIG. 2 shows cementing sites 9.

Instep shield 2 and closing flaps 3, 4 consist of a springy elastic, or a hard elastic material. In the relaxed state, these parts of the closing device remain in an open state, as FIG. 1 shows. Thermoplastic or thermoset materials, for example, polyamides, polyimides, polyurethanes, or the like, can be used as materials for instep shield 2 and closing flaps 3, 4.

The shoe upper 8 is formed of a natural or artificial leather, or a fiber fabric, and can also be provided with trimmings, for example, of natural or artificial leather or other materials. A fiber fabric part 8*a*, for reducing the weight of the sport shoe, is sketched under instep shield 2 in FIG. 1.

The side parts 6, 7 of shoe upper 8, as usual, is formed of leather, preferably, suede leather. The upper material of shoe upper 8 can be provided with a lining on the inside, and can also be provided with an inner padding layer.

A tongue 10, which also can be padded, and completely covers the throat area, is placed under side parts 6 and 7 of shoe upper 8. Preferably, a thermoplastic, pressure-transmitting padding material in the form of foamed polyethylene, polyurethane or ethylene vinyl acetate (EVA) is used as the padding.

Closing flaps 3, 4 can be pulled against instep shield 2 by a tightening element 11 that is designed as a rope or lace, for example, as a steel wire or wire or plastic rope. For this purpose, tightening element 11 runs from a central tightening lock 12, which is provided on instep shield 2, back and forth between instep shield 2 and closing flap 3 or 4, down along the length of the instep shield and then back up, and in each instance, the tightening element runs in arc-shaped guide channels 13 of guides formed in the instep shield 2 and flaps 3, 4.

The guide channels 13 run essentially parallel to the surface of instep shield 2 and closing flaps 3, 4, and are offset in relation to one another along their length, so that the tightening element 11 follows a path that at least approximates an S-shaped or wavy line. In this way, it is guaranteed that tightening element 11, during fastening, is clamped over the entire closing area SB and not just in partial areas, such as center area MB. The arrangement of guide channels 13 is selected so that, when the flaps 3, 4 are drawn toward the instep shield 2, an outlet end of a respective opening 14 of one guide channel 13 is congruently disposed opposite a respective inlet end of an opening 14 of an opposite guide channel 13 to which it passes.

In this embodiment, each closing flap 3, 4 has two guide channels 13, and instep shield 2 has a guide channel 13 on each side. However, especially in high-top sport, leisure or rehabilitation shoes, more guide channels 13 can be placed both in closing flaps 3, 4 and in instep shield 2.

Radius R of guide channels 13 is selected to be as large as possible, and is about 7 mm to about 15 mm, depending on the shoe size. The arc of guide channel 13 extends over an arcuate length measured as a vertex angle of about 100° to 180°.

To achieve the smallest possible friction between tightening element 11 and the wall of guide channels 13, instep shield 2 and closing flaps 3, 4 are made of an abrasion-resistant material having a low coefficient of friction, or the guide channels 13 are lined with such a material.

Alternatively, the guide channels 13 can be formed of a curved sleeve of a material of low coefficient of friction. Materials which are suitable for this purpose are, for example, polyamides, polyimides, polyesters, polyurethane. Also, metals which have good sliding properties, such as those used in sliding bearings may be used; especially suitable for the curved sleeves are high-grade steel, titanium or bronze.

Central tightening lock 12, preferably, is designed so that tightening element 11 can be tightened from both sides and locked in a finely stepped manner, or in at least an approximately infinitely variable manner. Advantageously, the central tightening lock 12 is designed as a turning lock, and is mounted to turn in instep shield 2.

Each closing flap 3, 4 has at least two spaced guide channels 13, which are placed at an interval corresponding to that of the two openings 14 of the guide channel 13 placed opposite them on the instep shield 2, so that guide channel 13 of instep shield 2 fills the gap the gap between them.

In this embodiment, a single tightening element 11 is provided, which runs from central tightening lock 12 down closing flap 3, through end 5 of instep shield 2 to the other closing flap 4, and back up closing flap 4 to the central tightening lock 12. However, it is also possible to use two tightening elements, one at each side of the shield 2. In such a case, it is also possible to use two central tightening locks, one of which pulls a tightening element running between closing flap 3 and instep shield 2, on the one hand, and the other of which pulls on the second tightening element running between closing flap 4 and instep shield 2, on the other hand.

Since instep shield 2, preferably, is formed of a hard elastic or springy elastic plastic, to be able to perform its function well as a large surface pressure distribution plate, it is advantageous to increase the flexibility of the instep shield 2, at least in its lower area. This can be done by thinning the material in a crosswise running direction in a plurality of places, such as is represented by the grooves 15 shown in FIGS. 1 and 4. Instead of grooves 15, an undulating or square-wave profile can be provided, as a result of which, besides the necessary flexibility, also sufficient extension reserves are provided.

To make possible an easy, low-friction pulling of closing flaps 3, 4 against instep shield 2 and an equally low-friction resilient return travel in the relieved state, slide sheets 17 are provided which cover the opening gap 16. The slide sheets 17 can be, for example, in the form of plastic sheets with a thickness of 0.2 mm to 0.5 mm, which are provided under instep shield 2 and closing flaps 3 and/or 4. These slide sheets 17 are formed or fastened, preferably glued, on one side, either to instep shield 2 or closing flaps 3 or 4, respectively. Thus, the slide sheets 17 support the parallel or arcuate closing movements of closing flaps 3, 4 toward instep shield 2 and the return opening movements away from it.

In the one-piece design of instep shield 2 with closing flaps 3, 4, round or rounded recesses 18 are provided on the connecting sites in the lower area of instep shield 2, i.e., at the beginning of opening gap 16, to reduce the notch effect at these connecting sites.

Figure 4:
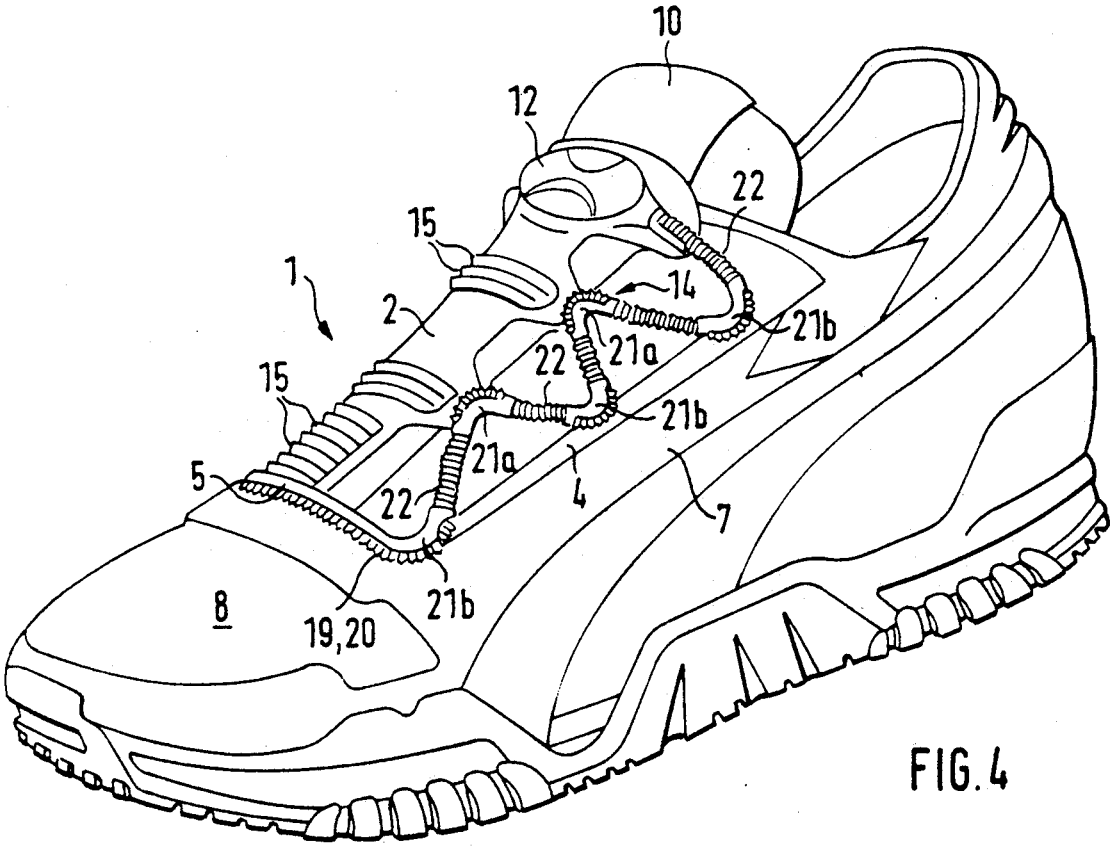
FIG. 4 is a perspective view of a sport shoe with a Bowden cable as a tightening element and a central tightening lock.

A steel wire or wire rope can be used as tightening element or tightening elements 11, which, optionally, can be surrounded by a plastic sheath having good sliding properties. However, the tightening element 11 can also be a Bowden cable, as represented in FIG. 4.

Figure 3:
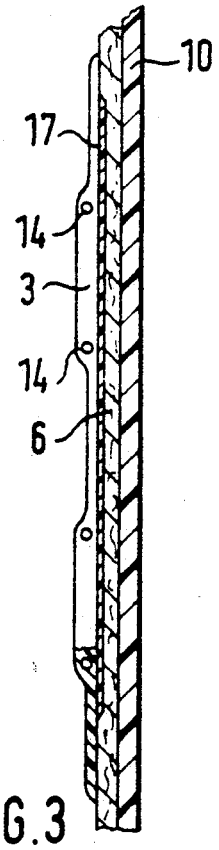
FIG. 3 is a sectional view taken along section 3—3 of FIG. 1.

In this embodiment, a Bowden cable 19 has a sheath 20 with compressible areas 22 located between fixed angular direction change guides 21*a*, 21*b* that are provided on the instep shield 2 and on the closing flaps 3, 4, respectively. These compressible areas 22 of sheath 20 are, preferably, designed as extensible or compressible bellows. Otherwise, the embodiment according to FIG. 4, in regard to the other parts of the closing device, corresponds to that of FIGS. 1–3.

Essential advantages of the described sport shoe with central closing device according to the invention, in comparison with known lace fastenings, and also the initially described double lace closing, can be seen in the security of the closing device. Especially, loops or parts of loops can no longer come loose. Also, a one-hand operation of the central tightening lock is possible, which is necessary both for types of sports for the handicapped, and the use of the closing device according to the invention in rehabilitation shoes. The danger of accident is clearly reduced by elimination of the suspended shoelaces. The continuous or at least almost continuous adjustment of the closing pressure over the entire closing area is important. Especially, the central tightening lock makes possible a quick and uncomplicated readjustment of the closing pressure.

In the embodiments described so far, according to FIGS. 1 to 4, parts 2, 3, 4 of the closing device are comprised of either an integrated homogeneous component or else instep shield 2 and closing flaps 3, 4, respectively, considered alone, each consist of a single component. However, for production reasons or also for reasons of the material stresses, a two-part embodiment can also be provided, as described below relative to FIGS. 5 and 6. Likewise, even if, basically, one or more crossings of tightening element or tightening elements 11 in center area MB are not to be excluded, the arrangement of the tightening element or tightening elements 11, in all the embodiments, should be made so that no crossings exist in the lower and upper parts 27, 28 of instep shield 2, such as is also shown relative to the embodiment of FIGS. 5 and 6.

FIG. 5, again, shows the central closing device comprised of instep shield 2, central tightening lock 12 and the two closing flaps 3, 4. Although, in this case, guides in the form of upwardly raised guide blocks 23 are provided on closing flaps 3, 4, instead of the guide channels 13 of FIGS. 1 and 2. Each of these guide blocks 23 has a protruding upper edge 24 (FIG. 5*a*), at least in the area that the tightening element or elements 11 are guided. This protruding upper edge forms a guide groove 25 in which the tightening element or elements 11 can slide, and which safeguards it from unintentionally becoming disengaged from guide block 23.

Guide blocks 23 are provided or fastened to closing flaps 3, 4 on sites that are disposed opposite one another, and the instep shield 2 has no guide channels 13 and/or guide blocks 23. Tightening element 11 is, thus, looped alternately, from one closing flap 3, 4, to the other closing flap 3 or 4, around diagonally corresponding guide blocks 23, and can be put under tension and relieved of tension by central tightening lock 12. Consequently, a crossing point 26 of tightening element 11 results in central area MB of the closing device, while in upper part 27 and lower part 28 of closing area SB, closing flaps 3, 4 are connected to one another without any such crossings.

Tightening element 11 is guided over instep shield 2 in grooves 29–33. Thus, first of all, a good guiding of the tightening element or tightening elements 11 in these areas is assured and, further, the tightening pressure applied by the tightened tightening element 11 on instep shield 2 is reduced, so that friction is reduced.

Figure 5A:
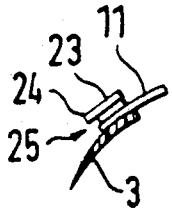
FIG. 5*a* is a sectional view taken along line 5—5 of FIG. 5.
Figure 5:
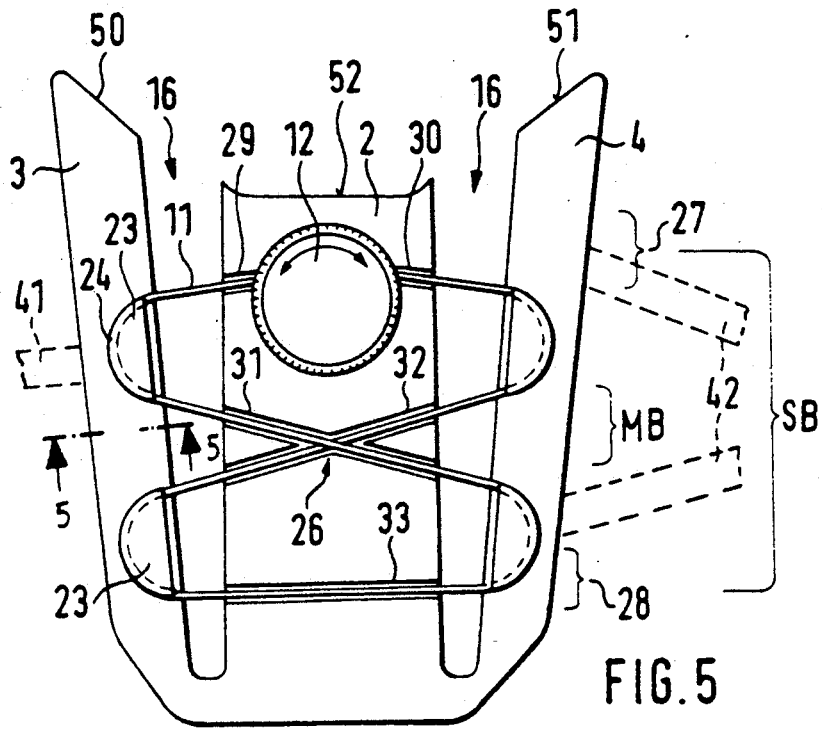
FIG. 5 is a top view of an instep shield having closing flaps and a central tightening lock with its cover removed.

As can be seen in FIG. 5, grooves 31 and 32 intersect at crossing point 26. To avoid, or exclude to the greatest possible extent, sliding of the material of tightening element(s) 11 on one another at crossing point 26, advantageously, one groove, here groove 31, is deeper than the other groove 32, as represented in FIG. 5. Preferably, the deeper groove 31 has a depth that is greater than that of the other groove 32 by an amount that is at least equal to the thickness of tightening element 11, so that the frictional pressure of the intersecting parts of tightening element 11 becomes negligibly small or is completely eliminated.

Figure 6A:
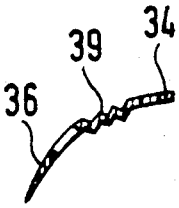
FIG. 6*a* is a sectional view taken along line 6—6 of FIG. 6.
Figure 6:
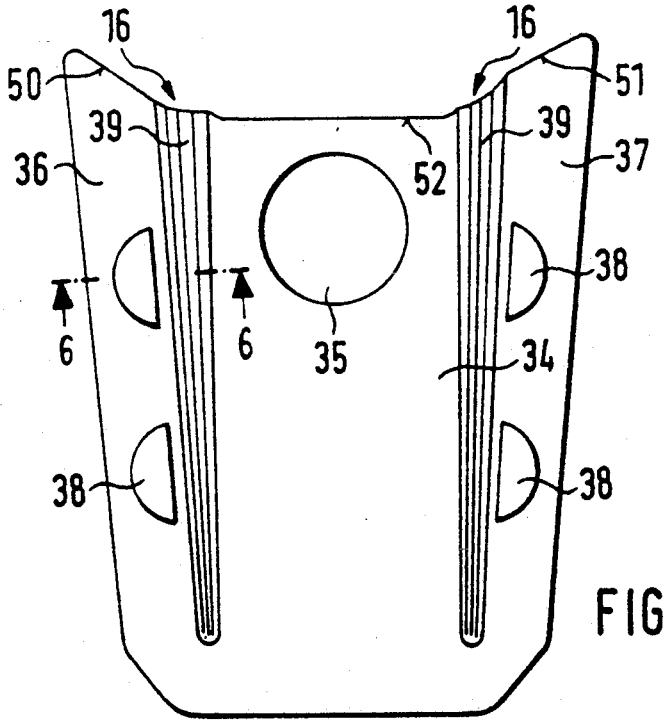
FIG. 6 is a top view of an instep shield cover and flap cover for a closing arrangement according to FIG. 5.

To cover grooves 29 to 33 of instep shield 2, an instep shield covering 34 can be applied to it so that grooves 29 to 33 are designed or maintained as channels for low-friction sliding of tightening element or elements 11. Such an instep shield cover 34 is represented in FIG. 6. Shield covering 34 is provided with a recess 35 for the passage of central tightening lock 12. It can be glued and/or sewn to instep shield 2 and/or is locked with instep shield 2 by known locking elements, for example, a locking hook, locking lug, or the like, provided on instep shield cover 34 and/or instep shield 2.

In the same way, a flap cover 36 or 37 can be provided on a respective one of the closing flaps 3, 4, as represented in FIG. 6, to cover, for example, the arch-shaped guides for tightening element 11 or guide grooves 25 represented in FIG. 5*a*. In the latter case, flap covers 36 and 37 have, in appropriate places, openings 38 in which guide blocks 23 engage or, for example, engage with projecting upper edge 24.

To prevent dirt and other impurities from reaching into the area of opening gap 16, a slide sheet 17 can be provided between instep shield cover 34 and adjacent flap covers 36, 37, as described relative to FIGS. 1 and 2. Alternatively, as shown in the embodiment of FIGS. 6, 6*a*, the instep shield cover 34 and flap covers 36, 37 can be integral parts of a single component, for example, of a stamped, injection-molded or cast part. In this case, instead of a slide sheet 17 or corresponding one-sided formed-on tab, a membrane 39 is provided that is continuous with the adjacent components, especially by being a molded or injected on portion. Preferably, this membrane 39 is designed to be able to be pushed or folded together, particularly, like a bellows (FIG. 6*a*).

Figure 8:
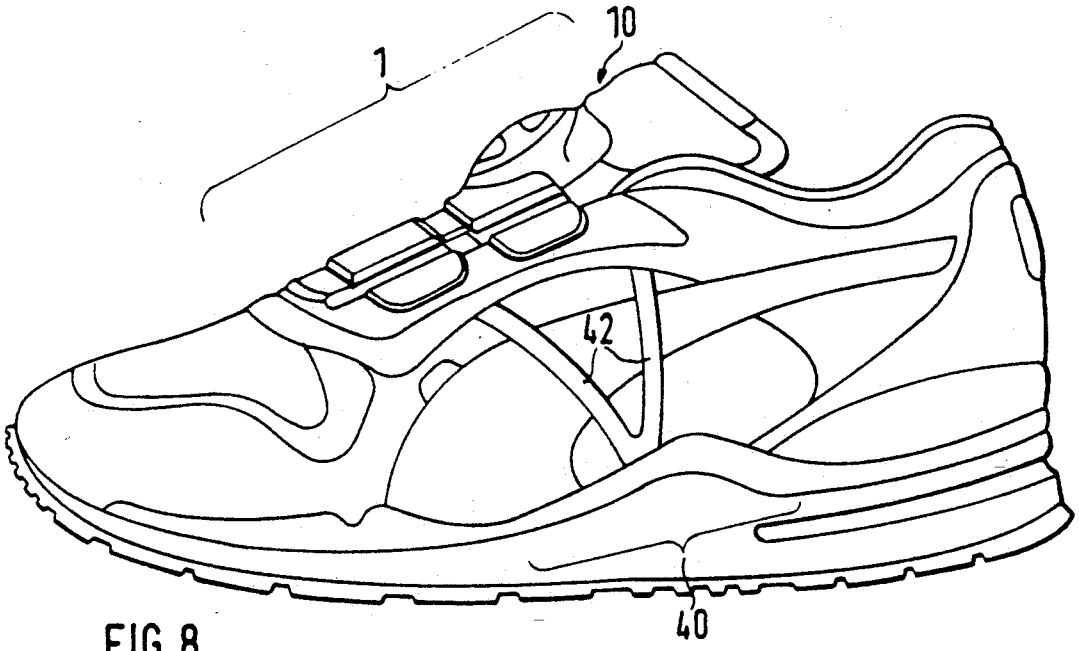
FIGS. 8 and 9, are side elevational views of a sport or leisure shoe with different tightening band configurations.
Figure 9:
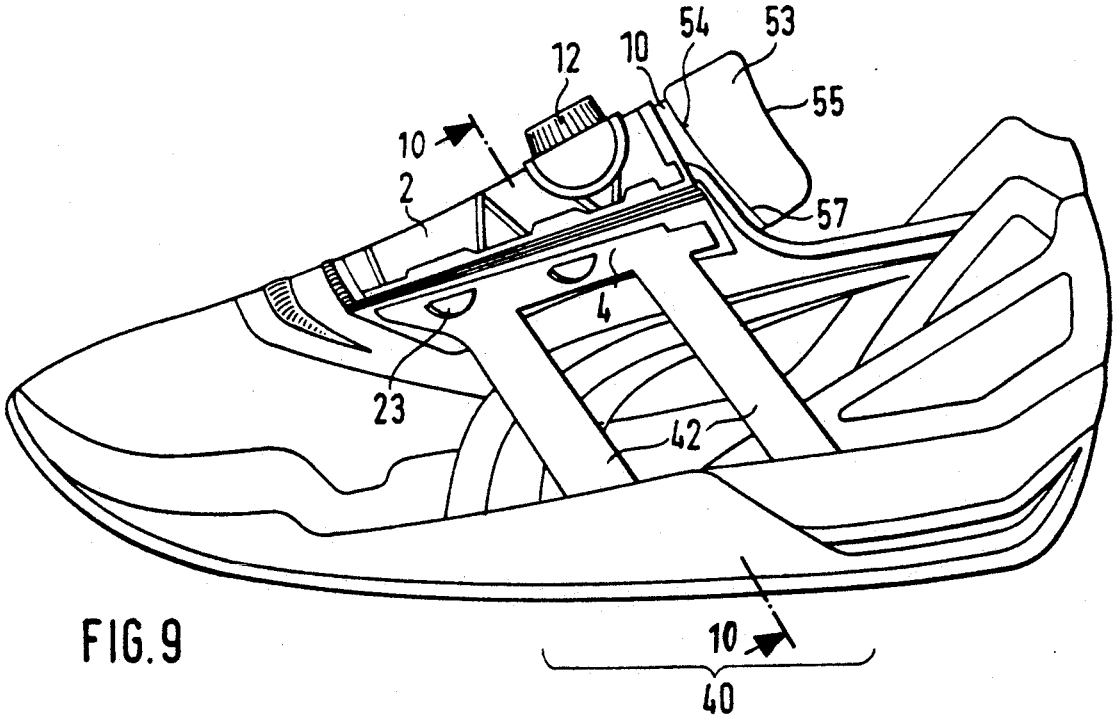

According to another advantageous configuration of the invention, at least one tightening band 41 or 42 is applied on each closing flap 3, 4 in the area 40 of the metatarsus (FIGS. 8, 9). The band 41, 42 extends laterally around the foot into sole area 43 of the shoe (FIG. 10) and is connected permanently to the upper material and/or sole material, for example, by being glued, sewn or riveted to it. Such tightening bands 41, 42 are indicated by broken lines in FIG. 5, one tightening band 41 being present on one, preferably, the inner, medial side, closing flap 3, and two tightening bands 42 being present on the outer, lateral side, closing flap 4.

Figure 7:
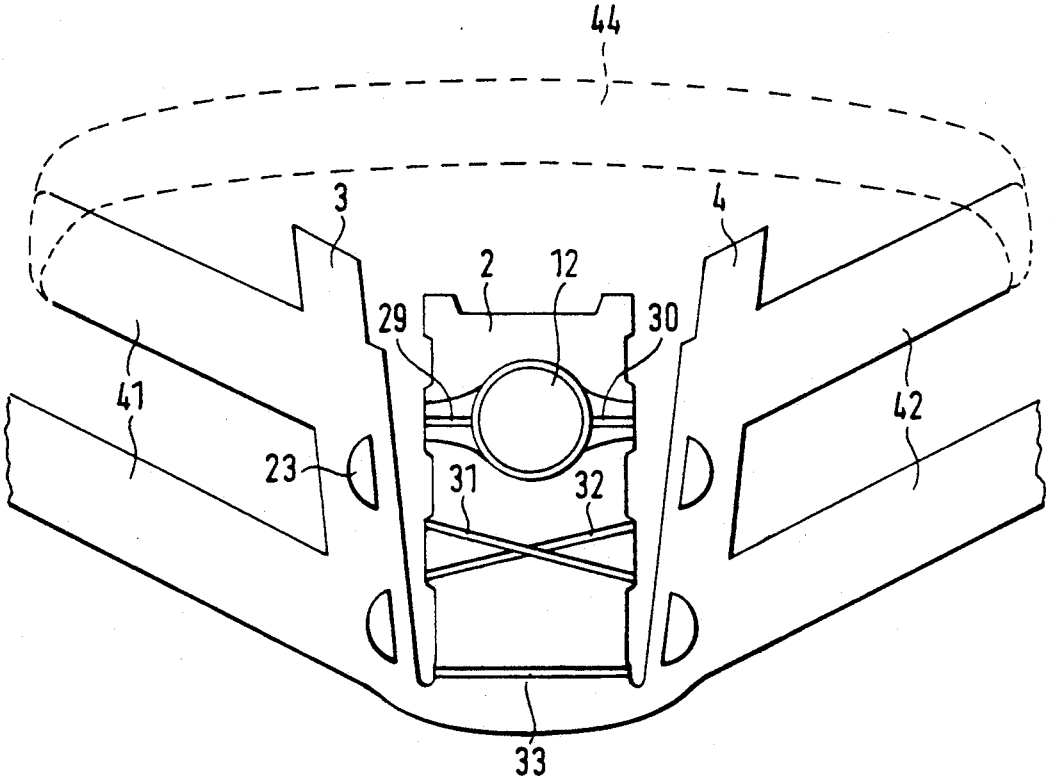
FIG. 7 is a top view of a closing device with additional side tightening bands with its cover removed.

In the embodiment according to FIG. 7, two tightening bands 41, 42 are provided on both of the two closing flaps 3, 4, and run parallel or approximately parallel to one another.

When two tightening bands 41 or 42 are provided on one or the other of closing flaps 3, 4, they can have a V-shaped relationship relative to one another. Such an embodiment is illustrated in FIG. 8.

Figure 10:
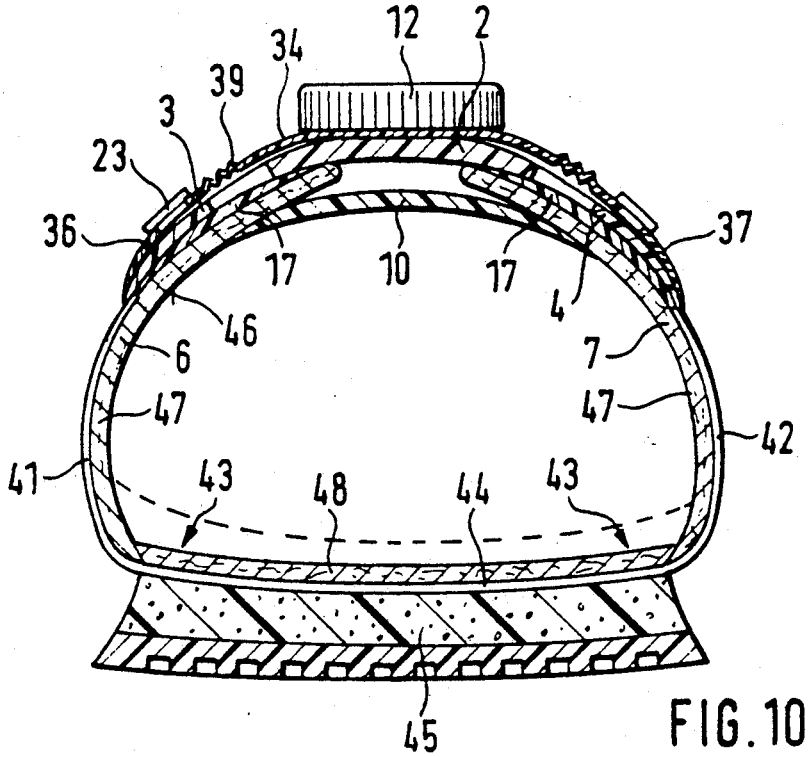
FIG. 10 is a sectional view taken along line 10—10 of FIG. 9.

Advantageously, the tightening bands 41, 42 can be connected to one another by a strap 44 which runs widthwise through entire sole 45 (FIGS. 7 and 10). Instep shield 2, closing flaps 3, 4 and tightening bands 41, 42, including strap 44, advantageously consist of a homogeneous injection-molded, cast or molded part.

Tightening bands 41, 42 can be placed on the inside 46 of the upper material 47 or within it, for example, between the outside material and the lining of the upper. Alternatively, the bands 41, 42 can be disposed on the outside of the upper (FIG. 10), especially, by being glued and/or sewn on. When they are arranged on the outside of the upper material, these tightening bands 41, 42 can be placed under or over trimmings of the upper material.

More favorably, the tightening bands 41, 42 end under the insole 48 or the strap 44 runs under this part of the shoe.

By mechanically connecting the tightening bands 41, 42 to the closing flaps 3, 4, on the one hand, and to the upper material and/or sole material, on the other hand, or by the connection of these tightening bands 41, 42 to a homogeneous strap 44 going through sole 45, a new type of width adjustment system is provided with which the inner measurements of the shoe upper can be matched exactly to the girth measurement of the foot. Thus, in this embodiment of the invention, central lock 12 performs a multiple function. It serves not only for producing a closing pressure that is uniformly adjustable and uniformly spread over the instep shield, but it causes, at the same time, an increased stability of the entire shoe in the sense that the danger of straining the sensitive joints and tendons, preferably, in the shoe outside (lateral) area, is reduced as much as possible.

Figure 11:
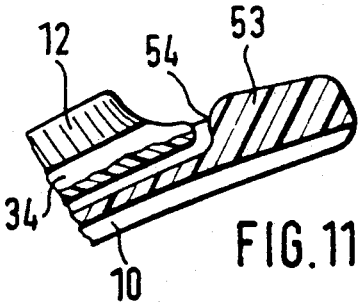
FIGS. 11 and 12 are longitudinal sectional views of a tongue end part.
Figure 12:
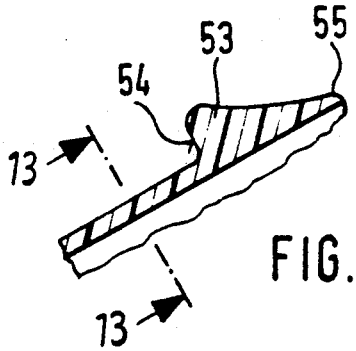
Figure 13:
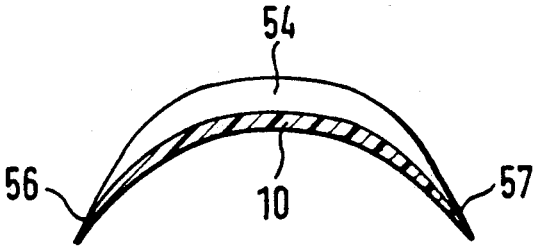
FIG. 13 is a sectional view of the tongue taken along line 13—13 of FIG. 12.

In an advantageous further development of the invention, as represented in FIGS. 11 to 13, a free-end part 53 of tongue 10, which projects beyond the upper boundary 49 (FIG. 1) of closing area SB or top edges 50, 51, of closing flaps 3, 4 and 52 of instep shield 2, or flap covers 36, 37 and instep shield cover 34 (FIGS. 1, 5, 6, and 9), is thickened so as to form a stop wall 54 in proximity to these top edges 49 to 52. In this way, these top edges form an abutment for the stop wall 54 of the tongue. As a result, tongue 10 is kept in the correct position in relation to the closing area, and, especially, is prevented from sliding into the shoe. This benefit is achieved, particularly if stop wall 54 of thickened tongue part 53 is oriented, at least approximately, at a right angle with respect to the unthickened part of tongue 10. Furthermore, advantageously, projecting tongue part 53 is tapered toward its upper free end, at which it ends with a rounding 55, as is seen in FIG. 12. Lateral edge areas 56, 57 of tongue 10 are tapered, as is known, toward the tongue edges, as FIG. 13 shows.

According to another advantageous configuration of the invention, the connection of closing flaps 3, 4 with end 5 of instep shield 2 is made as easily movable as possible. This can take place, for example, by the above-mentioned hinges or joints, especially spring joints. According to an embodiment represented in FIG. 14, the connection of these parts with the central closing device in connection area 58 takes place by corrugated or folded membranes 39.1, which can each be the continuation of a membrane 39.2 provided between instep shield 2 and closing flaps 3, 4, (left side in FIG. 14) and which reach to or almost to end edge 5.1 of the lower end of instep shield 2.

Figure 15:
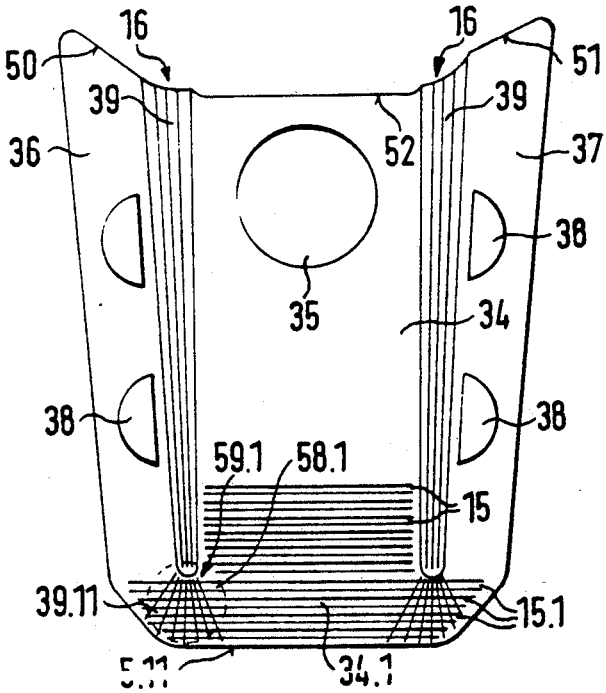
FIG. 15 is a top view similar to that of FIG. 6 but of a modified embodiment of the instep shield and the flap covering.

In a corresponding way, according to FIG. 15, such corrugated or folded membranes 39.11 can also be provided in front connection area 58.1 of instep shield covering 34 and of flap coverings 36, 37, if such an instep shield covering 34 is provided. To guarantee that the mobility of these parts will be as unhindered as possible, optionally, a connection of closing flaps 3, 4 to instep shield 2 can be completely dropped.

Figure 14:
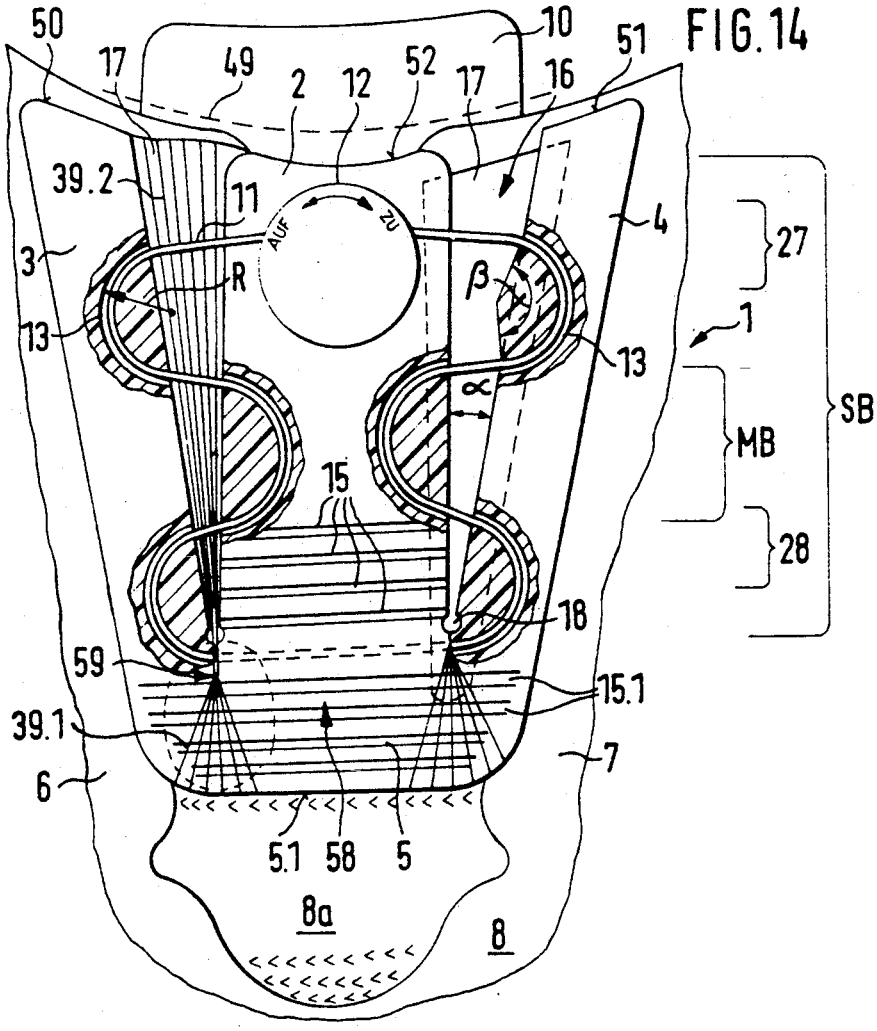
FIG. 14 is a top view similar to that of FIG. 1 but of another embodiment where the closing device according to the invention is made particularly flexible at the lower end of the closing device.

Preferably, folded membrane 39.1 or 39.11 runs in the direction of a real or imaginary connection point 59 between instep shield 2 and closing flaps 3, 4, as represented in FIG. 14, or from connection point 59.1 between instep shield covering 34 and flap coverings 36, 37 (FIG. 15) to end edge 5.1 of end 5 of instep shield 2 (FIG. 14) or to end edge 5.11 of end 34.1 of instep shield covering 34 (FIG. 15).

To increase the flexibility of the connection areas 58 or 58.1 of instep shield 2, and optionally instep shield covering 34, preferably their ends 5.1 or 34.1 are made resiliently flexible by suitable measures. For example, by using material that is very thin and/or by additional cross grooves or cross undulations 15.1 (see FIG. 14 and 15), especially in the form of a corrugated or folded membrane.

Thus, by the end or connection areas 58 or 58.1, pressure points are avoided on the forefoot. Cross grooves 15.1 in this case can be superposed on the folds of membranes 39.1 or 39.11.

FIG. 15 further shows an opening 35 for the passage of central tightening lock 12. Finally, openings 38, into which guide elements or guide blocks 23 engage or, for example, engage with a projecting upper edge, are provided in flap coverings 36, 37 at corresponding places. Preferably, telescopic or foldable membranes are identified by reference number 39.

Figure 16:
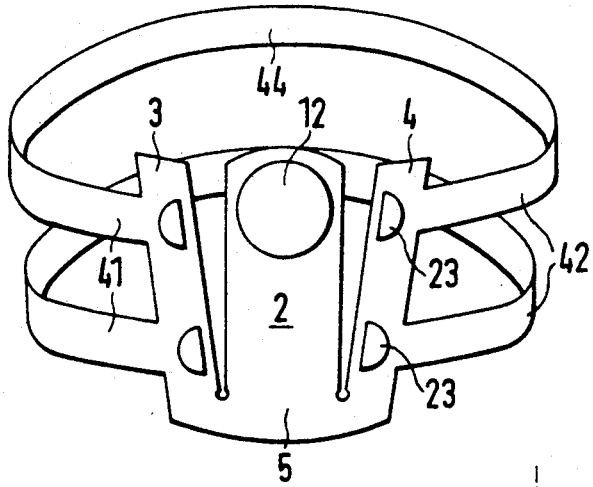
FIG. 16 is a diagrammatic perspective view of another embodiment of the closing device according to the invention with closed tightening bands.

With the use of tightening bands 41, 42, the latter can, as represented in FIG. 7, be directly formed on closing flaps 3, 4 during their production. Alternatively, they can also be fastened on them in any suitable way, for example, by sewing, riveting, gluing or the like. In this case, guide elements or guide blocks 23 are suitably placed on closing flaps 3, 4, so that they are aligned with tightening bands 41, 42, as represented in FIG. 16. In this way, the tension of tightening element 11 is transferred directly to tightening bands 41, 42.

Figure 17:
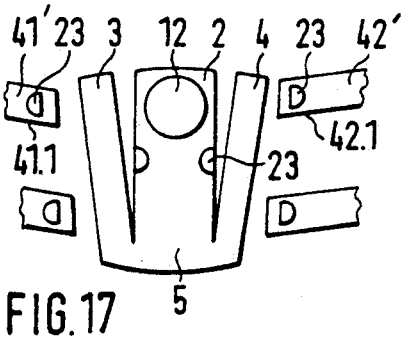
FIG. 17 is a partial top view of another embodiment of the closing device according to the invention with tightening bands separated by closing flaps.

In another embodiment of the invention, according to FIG. 17, tightening bands 41', 42' are separate from closing flaps 3, 4, and guide elements or blocks 23 are provided on ends 41.1 or 42.1, respectively, of a tightening lace 41', 42'. Instead of guide elements or guide blocks 23 of the type described so far, guide elements or guide blocks 23 of another suitable form and design, especially in the form of loops, holes, eyelets, Ghilly eyelets or the like can also be provided. Guide elements or guide blocks 23 can be formed on, clipped on, glued on, riveted on or fastened in another way to tightening laces 41, 42.

Figure 18:
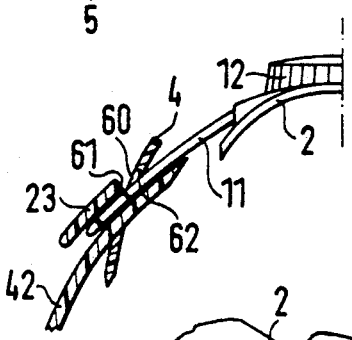
FIG. 18 is a cross section of the left part of the closing device according to FIG. 17 seen from the rear.
Figure 19:
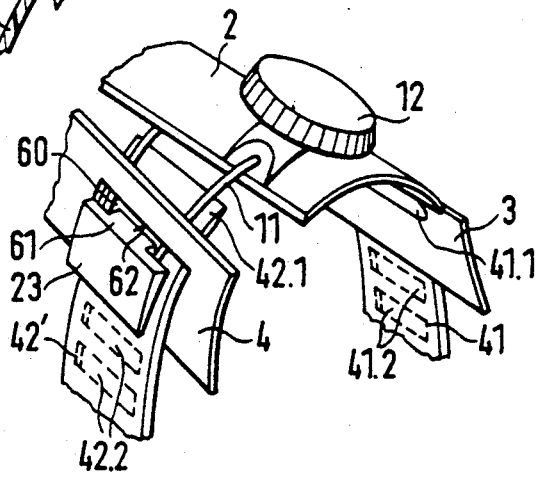
FIG. 19 is a part of the closing device according to the invention in perspective view, with tightening bands inserted into slots of the closing flaps of the embodiment shown in section in FIG. 18.

According to another embodiment of the invention, the separate tightening bands 41', 42' can be introduced into slots 60 of closing flaps 3, 4, and can be arranged to be stationary there, but preferably can be arranged to be movable as represented in FIG. 18 and 19. In this case, ends 41.1 or 42.1 of tightening bands 41', 42' are inserted through slots 60 and overlap closing flaps 3, 4. In each case, a guide element 23 is provided on the tightening band at a section which does not extend into slot 60. The guide element or guide block 23 each, as described above, can be designed as a differently configured type guide element, can be formed on, glued on, riveted on or fastened in another way. Advantageously each guide block 23 or each guide element has a stop edge 61 on its upper end. This stop edge 61, suitably, in the open state of the closing device is removed from upper slot edge 62 by a certain amount, for example, 5 mm to 20 mm. Thus, in the closing process by tightening element 11, first a tightening of tightening bands 41', 42' occurs with the corresponding turning of central tightening lock 12, by which the foot is held firmly, and only with an additional tightening of tightening element 11 does stop edge 61 strike against upper slot edge 62 and, thus, brings closing flaps 3, 4 into the closing position. In this way a good fit of the foot in the shoe is guaranteed. Corresponding with the unlocking of central tightening lock 12, the closing device first opens, and by the further slackening of tightening bands 41', 42' the loosening of the foot in the shoe takes place.

Figure 20:
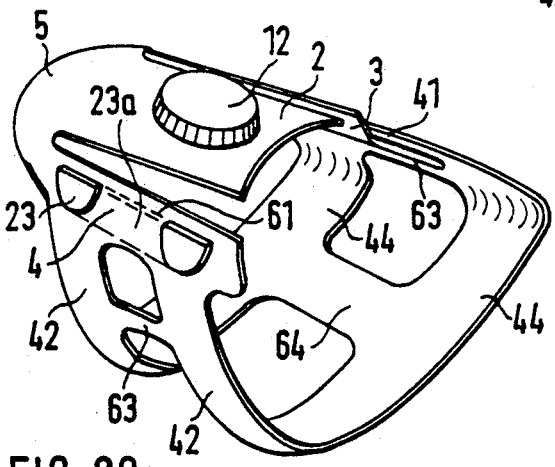
FIG. 20 is a perspective view of the closing device according to the invention with two tightening bands connected with one another by straps.

To obtain a more uniform pressure distribution, guide elements or guide blocks 23 on tightening bands 41', 42' can be connected with one another by a strap 23*a*, such as that diagrammatically represented by dotted lines in FIG. 20. Thus, a common stop edge 61 (for this purpose, see also FIGS. 18 and 19) strikes respective closing flaps 3 or 4 with broad surface.

To be able to enlarge even more of the area of width adjustment obtained with tightening bands 41, 42 of greatest possible uniform size, tightening laces 41, 42 on their end areas adjacent to closing flaps 3, 4, can be provided with locking elements 41.2 or 42.2 of known type, such as core pin connections, screw connections or the like, which make possible the fastening of guide elements or guide blocks 23 or differently configured guide elements at different places on the end areas of tightening laces 41, 42. Such locking elements 41.2 or 42.2 are represented diagrammatically in FIG. 19.

According to another configuration of the invention represented in FIG. 20 when two or more tightening bands 41, 42 are used, one or more lateral connection straps 63 are advantageously provided between adjacent tightening bands 41, 42. Also tightening bands 41, 42 on one or on each side of the closing device can be connected with one another by a strap 44 and adjacent straps 44 can also be connected to one another by another fastening strap 64, as shown in FIG. 20. In this way an easy incorporation of this complete cage comprised of tightening bands 41, 42, connection straps 63, 64, straps 44 and instep shield 2 or, in the case of separate instep shield 2, of the then present partial case, is guaranteed.

Figure 21:
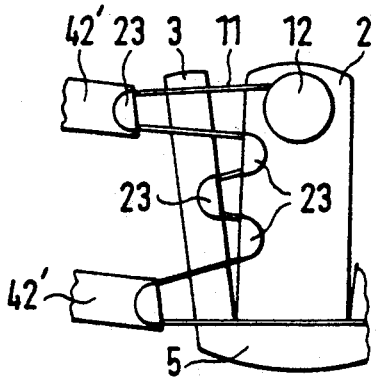
FIG. 21 is a top view of a section of the closing device according to the invention with separate tightening bands.
Figure 22:
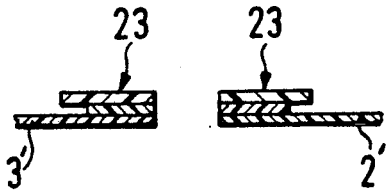
FIGS. 22 to 25 are cross-section views of alternate configurations for the guide elements.
Figure 23:
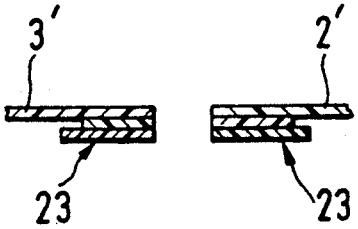
Figure 24:
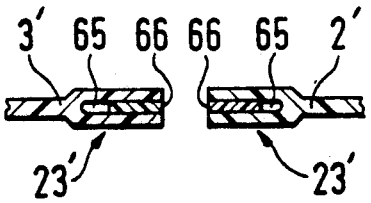

Another advantageous embodiment of the invention consists in the fact that according to FIG. 21 with tightening bands 41', 42' that are separate from closing flaps 3, 4 (only tightening bands 42 are represented in the drawing) guide elements or guide blocks 23 are provided on the tightening bands 41', 42' and other guide elements or guide blocks 23 are provided on the lateral areas of instep shield 2. Supplementing this, on closing flaps 3, 4 other guide elements or guide blocks 23 are provided between those provided on tightening bands 41', 42' and instep shield. Thus, in the case of tightening bands 41', 42' that are separate from closing flaps 3, 4, a carrying along of closing flaps 3, 4 is also caused during closing of central tightening lock 12 in the closing direction.

Figure 25:
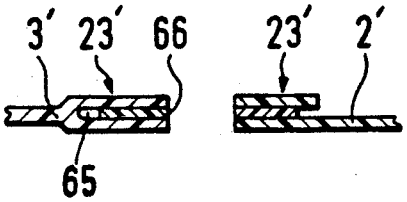

As shown in the cross-sectional views of FIG. 22 to 25, guide elements or guide blocks 23 or the differently configured guide elements can be provided on the outside (see FIG. 22) or inside (see FIG. 23) on instep shield 2 and on closing flaps 3, 4, and also optionally on the tightening bands (not represented here). However, the guide elements or guide blocks 23 or the differently configured guide elements can also be placed in slots 65 on the edge each of instep shield 2, of closing flaps 3, 4 and/or of the tightening bands (FIG. 24) or only in slots 65 on closing flaps 3, 4 and optionally on the tightening bands (FIG. 25). Especially in this case, guide elements or guide blocks 23' can be designed as a semicircular disk 66 or as pin, bolt or the like (cf. FIG. 24 and 25).

As FIG. 25 clearly shows, in this embodiment of the invention guide elements or guide blocks 23 or differently configured guide elements are provided on instep shield 2 on the outside and only in slots 65 on the adjacent closing flaps 3, 4.

In the course of tightening the bands 41, 42 over the outside of the upper material 47 of the shoe (FIG. 10), a glass-clear transparent or cloudy translucent material or a colored transparent material can be used for the tightening bands. Thus, it is possible to quickly see and remove possible impurities under tightening laces 41, 42. In this configuration of the invention, underlying upper material 47 is also visible, so that the aesthetic effect of the shoe is retained and optionally also trademark characteristics on such a shoe remain visible.

According to the further development of the invention represented in FIG. 26, guide channels 13 are designed so that at least one inwardly extending, elongated slot-shaped groove 101 is provided on each narrowside 3.1, 4.1 of the flaps 3,4. On both sides of instep shield 2 at least one guide element or guide block 23' is fixedly inserted in each of the grooves 101 to receive the traction forces occurring in tightening of the tightening element 11. Tightening element 11, in each case, loops around a curved sliding surface of guide elements or guide blocks 23'.

Width 101.1 of grooves 101 is equal to or only a little larger than the thickness of guide elements or guide blocks 23'. In each closing flap 3, 4, at least one guide element and guide block 23' each is inserted and fastened, for example by gluing and/or heat-sealing, in grooves 101. On outside edge 23.1 of guide elements or guide blocks 23' a guide groove 25, each acting as a sliding surface (FIG. 27A) is provided, in which tightening element 11 comes to lie. Guide elements or guide blocks 23' are comprised of a harder material than the material of instep shield 2 and closing flaps 3, 4 and very friction-resistant, such as, for example, polyamide, polyethylene, polyurethane or the like with a hardness preferably greater than 75 Shore A. By the separate production and fastening of guide elements or guide blocks 23', on the one hand, and of instep shield 2 as well as closing flaps 3, 4, on the other hand, for the optimal choice of materials for these components is easily possible The material of instep shield 2 and that of closing flaps 3, 4 therefore can preferably be selected from the viewpoint of elasticity or springy elasticity and less from that of abrasion resistance.

Guide channels 13 run in the plane of instep shield 2 or of closing flaps 3, 4 and thus are placed offset to one another so that tightening element 11 runs at least approximately in an S-shaped or wavy manner. In this way it is guaranteed that tightening element 11 during fastening over entire closing area SB. The arrangement of guide channels 13 is selected so that in closing flaps 3, 4, i.e., drawing them closer to instep shield 2, an opening 14 of a guide channel 13 is congruently opposite a respective opening 14 of an opposite guide channel 13.

In the embodiment represented. each closing flap 3, 4 has two guide channels 13 and instep shield 2 has a guide channel 13 on each side. Especially in high-top sport shoes, but also in leisure or rehabilitation shoes, more guide channels 13 can be placed both in closing flaps 3, 4 and in instep shield 2.

Radius R of guide channels 13 is selected to be as large as possible and is at least about 7 mm to about 15 mm, depending on the shoe size. The arc of guide channel 13 extends over a vertex angle beta of about 100° to 180°.

However, guide channels 13 can also consist of a guide element formed by a curved sleeve of a material with a low friction coefficient. Suitable materials for this purpose are, for example, polyamide, polyimide, polyester, polyurethane or also metals with good sliding properties as used in sliding bearings The curved sleeves can consist especially of high-grade steel, titanium or bronze.

Central tightening lock 12 is preferably designed so that tightening element 11 can be tightened and loosened from both sides in a finely stepped manner, approximately continuously or even continuously. Advantageously, central tightening lock 12 is designed as a turning lock and is mounted to turn in instep shield 2.

Each closing flap 3, 4 has at least two guide channels 13 or guide blocks 23, which are placed in the interval of the two openings 14 of guide channel 13 placed opposite on instep shield 2, so that guide channel 13 of instep shield 2 is placed to fill the gap. In the illustrated embodiment, a single tightening element 11 is provided, which is pulled from central tightening lock 12 over closing flap 3 to instep shield 2, back to closing flap 3 and then through end 5 of instep shield 2 to the other closing flap 4 and in the same course back to central tightening lock 12. However, it would also be possible to use two central tightening locks, each of which coacts with respective tightening element between closing flap 3 and instep shield 2, on the one hand, and closing flap 4 and instep shield 2, on the other hand.

Significant advantages of the described central closing device for sport, leisure or rehabilitation shoes in accordance with the invention in comparison with known lace closings, such as the initially described double lace closing, can be seen in the reliability, the simple producibility and favorable choice of material for the closing device. Also a one-hand operation of the central tightening lock is possible, which is beneficial for when the closing device in accordance with the invention is used in rehabilitation of sport shoes needed by handicapped persons. The danger of accident is clearly reduced by elimination of the trailing shoe laces. The continuous or at least almost continuous adjustment of the closing pressure over the entire closing area is important. Particularly, the central tightening lock makes a quick and uncomplicated readjustment of the closing pressure possible in the sense of increasing or reducing the closing pressure.

In the embodiments according to FIGS. 26 to 31 parts 2, 3, 4 of the closing device consist either of an overall integrated homogeneous component or else instep shield 2 and closing flaps 3, 4 respectively, considered alone, each consist of a single component, which are functionally connected to one another by suitable means.

In the embodiment according to FIG. 29, guide elements or guide blocks 23 are placed exclusively in closing flaps 3, 4 on sites opposite one another so that instep shield 2 has no guide elements or guide blocks 23' whatsoever. Tightening element 11 is thus looped alternately from one to the other closing flap 3 or 4 around corresponding guide elements or guide blocks 23' in central area MB and can be put under tension and relieved of tension by central tightening lock 12. Consequently there results a crossing point 26 of tightening element 11 in central area MB of the closing device, while in upper part 27 and lower part 28 of closing area SB, closing flaps 3, 4 are connected to one another and are not crossed.

To prevent impurities from reaching into the closing area of opening gap 16 a slide sheet 17 can be provided between instep shield 2 and adjacent closing flaps 3, 4, as depicted in FIG. 1 which has already been described.

In FIGS. 26 and 29 in the drawing on the right side, respectively, instead of a slide sheet 17, or in addition to it, a vamp 17.1 is placed on, especially directly formed on, a free side edge of instep shield 2. This ramp 17.1 engages in a common or in several individual pocket-shaped slot(s) 102 of closing flap 4 and, upon tightening of the closing device by central tightening lock 12, sinks correspondingly deeper into it/them. Guide elements or guide blocks 23' are inserted into slot or slots 102 and are fastened there at the appropriate places, preferably with their front side 23.2 recessed. Thus vamp 17.1 can sink into the free section 101.2 of groove 101 provided it extends over the entire length of instep shield 2. Moreover, it is also possible to limit the length of vamp 17.1 so that it sinks only in the area above the uppermost guide element or guide block 23' (FIG. 26) or only between upper or lower guide element or guide block 23' into slot or slots 102.

As shown by FIG. 30, another form of guide elements or guide blocks, 23'', and the form of groove 101 of closing flaps 3, 4 are matched to one another so that, with guide block 23'' inserted, the potential for rotation within surface plane 23.3 (FIG. 30A) is eliminated. This is achieved, here, by a rectangular, in top view, outside configuration of guide element or guide block 23'' and a corresponding rectangular design of groove 101 as shown in perspective in FIG. 30A. According to FIG. 30 and 30A, a locking projection in the form of an end piece of a pin 23.4 is formed on both sides of guide element or guide block 23'' or a through pin is inserted in guide element or guide block 23. The pin end pieces 23.4, which project from the block on both sides, engage in an inside or through recess or in a corresponding opening 105 of side walls 103, 104 of groove 101 (FIG. **30*b*), by side walls 103, 104 being pulled away from one another in springy elastic manner. After insertion of pin end pieces 23.4 in the recess, the guide element or guide block 23''** is retained in position without additional adhesives or the like.

If end pieces 23.4 are formed on a pin which is to be inserted completely through guide element or guide block 23 instead of on its sides, and recess 105 is a through-opening in at least one of the side walls 103,104 (FIG. 30B), the guide element or guide block 23'', also, can first be inserted in groove 101 and then, by pushing in of the pin, the guide element or guide block 23'' can be fixed in position. It is also possible to provide other locking and/or clamping means for fastening and/or fixing guide element or guide block 23'' in position. Further, for preventing rotation, two or more pins 23.4 can be provided per guide element or guide block 23.

According to another advantageous configuration of the invention, two guide elements or guide blocks 23'' can be placed next to one another perpendicular to the longitudinal axis of instep shield 2, for example formed on or fastened on instep shield 2, especially on underside 2.1 (FIG. 31), but also on the upper side of instep shield 2, in the space formed by the two closing flaps 3, 4. A loop 11.1 that extends from a closing flap 3 or 4 and passes around these two guide elements or guide blocks 23'' so that tightening element 11 does not cross (FIG. 26). These guide elements or guide blocks 23 can suitably be combined into one structural unit 23.5, as represented in FIG. 31 in the cross section of instep shield 2. Structural unit 23.5 contains a center piece 23.6 which is fastened on underside 2.1 of instep shield 2 by a plug and/or locking connection. In the embodiment of FIG. 31, a pin 2.2 on instep shield 2 engages through a corresponding hole of center piece 23.6 for this purpose.

Fastening of guide elements or guide blocks 23'' on underside 2.1 of instep shield 2 can take place by heat-sealing, gluing, locking, riveting or the like.

Advantageously, instep shield 2 has a depression 106 on underside 2.1 (FIG. 31) in which structural unit 23.5 is incorporated. In this way, a troublesome pressure on the instep shield of the foot is avoided.

According to a further advantageous configuration of the invention, structural unit 23.5, or at least its preferably depressed center piece 23.6, can be fixed in position by stop plate 107 or additionally fixed in position by a stop plate 107 being slipped on pin 2.2 and being glued and/or locked and/or riveted and/or heat-sealed to this pin (FIG. 31).

In the embodiment according to FIG. 30, instep shield 2 and closing flaps 3, 4 are formed of a single component, for example, of a stamped, molded or cast part. In this embodiment, instead of slide sheets 17 (FIG. 26, left side) or correspondingly formed-on vamps 17.1 (FIGS. 26 and 29, right side), membranes 39, especially formed on, for example injected on, continuous with the adjacent components, are provided. These membranes 39 are, preferably, designed to be pushed or folded together, especially like a bellows. Membranes 39 are provided, preferably, above the tightening element or elements, so that a perfect hermetic seal toward the outside is obtained.

According to another advantageous feature of the FIG. 29 embodiment, at least one tightening band 41 or 42 is provided on each closing flap 3', 4' in the area of the metatarsus, and laterally goes around the foot into the sole area of the shoe. Such a tightening band 41, 42 is connected permanently to the upper material and/or the sole material of the shoe, for example, by being glued, sewn or riveted. It is also possible to connect these tightening bands 41, 42 with one another by one or more straps. Such tightening laces 41, 42 are indicated by broken lines in FIG. 29, with one tightening band 41 being present on one, preferably on the inner (medial) side closing flap, and two tightening bands 42 can be present, preferably on the outer (lateral) side closing flap. With the use of two tightening bands 41 or 42 on one or the other closing flap 3 or 4, they can run in a V-shaped manner relative to one another as described relative to the FIG. 5 embodiment.

Finally, according to another configuration of the invention, it is also advantageous that instep shield 2 be fastened, preferably detachably fastened by a snap connection, on closing flaps 3, 4 or a strap 75 which connects them at toe-directed end 5 of the shoe. Such an embodiment is represented in FIGS. 32 and 33. Here, pins 68 project downward from within a depression 67 formed on the underside of strap 75, and engage in, for example lock in, correspondingly matched holes 69 of a thinned tongue extension 70 of instep shield 2. Additionally, a gluing and/or heat-sealing of the parts that are to be joined to one another can be performed.

Additionally, fastening flanges 73 (which are formed on outside edges 71 of closing flaps 3, 4, and which are thinned in the cross section and tapered to a point toward end 72) are represented in FIGS. 32 and 33. With these fastening flanges 73, the closing device can be glued on or in and/or stitched on or in, on or under the upper material of a corresponding shoe or between layers of an upper material formed of at least two layers. A fastening flange 50 can also be provided on tongue extension 70 of instep shield 2. A fastening flange 73 provided on all outside edges 71 of closing flap 3 and strap 75 is indicated in FIG. 29 on closing flap 3 by dash-dot line. A corresponding fastening flange can, of course, also be provided on closing flap 4 and on adjacent strap 75.

Figure 34:
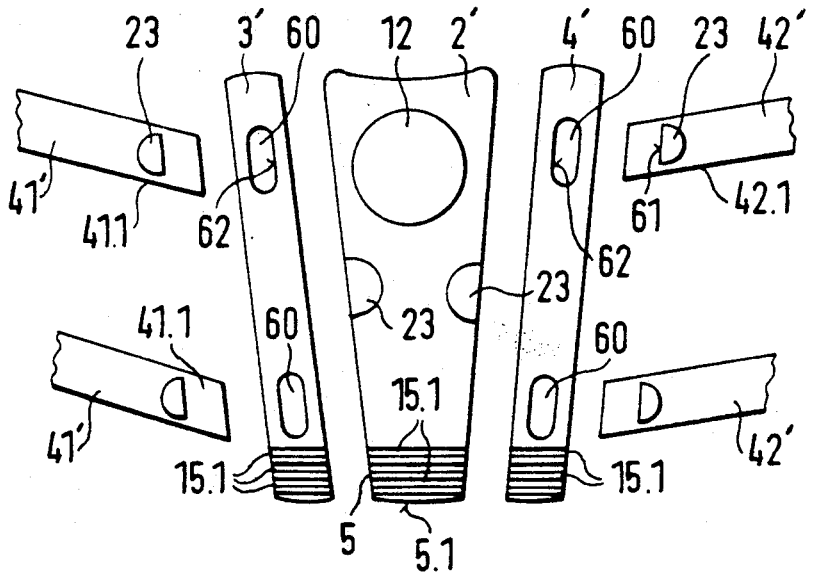
FIG. 34 is a partial view of a closing device with closing flap and tightening bands arranged separated from the closing flaps.

According to another embodiment represented in FIG. 34, instep shield 2', seen in top view, can be tapered width-wise toward its end edge 5.1 (i.e., narrow cross-wise in a direction toward toe-end 5) and especially, can run in a conical or wedge shape. This is advantageous in a narrow shoe design. Moreover, with the use of a material weakening and/or the use of undulations and/or grooves 15.1 at toe-directed end 5 of instep shield 2, an embodiment that is especially flexible in this area results.

Moreover, in the embodiment represented in FIG. 34, as already initially mentioned, instep shield 2' is completely separated from closing flaps 3', 4' and these parts are, thus, all made as individual elements. In this case, instep shield 2, at toe-directed end 5, is connected in a tongue-like manner to the shoe upper material, for example, by sewing and/or gluing and/or riveting or in another suitable way. Closing flaps 3', 4' can be fastened on edge surfaces of the upper material lying in the opening area by sewing and/or gluing and/or riveting or the like.

Guide elements or guide blocks 23, 23' can be provided on closing flaps 3', 4' and on instep shield 2', in any of the manners described relative to FIGS. 1 to 4, 14, and 22 to 26. However, guide elements or guide blocks 23 are shown in FIG. 34, on separate tightening bands 41', 42' which can be attached in their end areas 41.1, 42.1, as already described relative to FIGS. 18 and 19, via slots 60 provided in closing flaps 3', 4' for inserting of the end areas 41.1, 42.1 of the tightening bands 41, 42. In this case, guide elements or guide blocks 23, advantageously, each have a stop edge 61, which comes into operating connection with a slot edge, for example, with upper slot edge 62 of slot 60 in the closing process. Guide elements or guide blocks 23 of instep shield 2' can be placed on its upper side or on its lower side, as was already described.

Also, in the separate design of instep shield 2', closing flaps 3', 4' and tightening bands 41', 42' as individual elements, material weakenings and/or undulations and/or grooves 15.1, can be provided running crosswise to the longitudinal axis of the shoe on the ends of the closing flaps 3', 4' which are directed toward the shoe toe and on toe-directed end 5 of instep shield 2' to obtain a high flexibility in these areas.

Especially in a configuration of the invention with an instep shield 2' tapered toward the front, for example, according to FIG. 34, edges 3.1, 4.1 of closing flaps 3', 4', preferably, lie parallel to the adjacent edges of instep shield 2'.

The use of separate instep shield 2' and closing flaps 3', 4' allows, using a material of high longitudinal flexural strength for them (except in the end areas, e.g., on toe-directed end 5 of instep shield 2), a good flexibility in the crosswise direction is achieved between instep shield 2', on the one hand, and closing flaps 3', 4', on the other hand. Thus, an especially good adaptability of the closing device and, thus, of the shoe is achieved over the instep arch of the foot. At the same time, the uniform, continuous closing process is maintained and a practically parallel movement of the closing flaps in the closing process can be achieved, which promotes a uniform pressure distribution in closing.

With the closing device according to the embodiments of FIGS. 1 to 33, insofar as there instep shield 2 and closing flaps 3, 4 form a homogeneous component or a homogeneous component composed of individual parts, parts 2, 3 and 4, preferably, consist of a springy elastic plastic with a degree of hardness in the range of 75 Shore A to 90 Shore A. Thus, these plastic parts are classified as "hard" plastic parts.

With the closing device according to the invention according to FIG. 34 with separately produced components 2',3' and 4', these components can consist of a less hard, elastic plastic parts, preferably, with a degree of hardness in the range of 60 Shore A to 70 Shore A. In this embodiment guide elements or guide blocks 23 consist of a very hard plastic, preferably with a degree of hardness in the range of 75 Shore A to 90 Shore A.

In conclusion, it is to be pointed out that except for the embodiment according to FIG. 34, basically, also in the embodiments according to FIGS. 16, 17, 20 and 21, instep shield 2 and closing flaps 3, 4 each can consist of separate components.

Alternately, it is also possible, even in these embodiments to connect parts 2, 3 and 4 of the central closing device with one another in a hinged or jointed manner, and the joints can also be configured as folded or otherwise highly elastic membranes. In a comparable way, as described earlier, in these embodiments also the toe-directed end 5 of instep shield 2 and the connection of this part with the shoe upper can be made by undulated or folded membranes, as was described relative to FIGS. 14 and 15.

Because of the multiple advantages represented above in detail, the shoes with the described central locking device according to the invention are suitable not only for normal walking shoes, sport and leisure shoes, but also for rehabilitation shoes, i.e., shoes for persons recovering from an injury or surgery, in which the described advantages in the operation and strength of the central closing system are especially important.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Shoe provided with a closing device, especially a sport, play or rehabilitation shoe, having an upper of at least one material that is flexible under tensile stresses in a throat area of the upper, and with an instep shield which covers an instep area and to which side parts of the upper are adjustably fastenable on opposite sides of the instep shield by at least one tightening element; wherein a respective closing flap made of an elastic or springy elastic material is permanently attached on a respective side part of the upper adjacent a respective side of the instep shield and is displaceable relative to said respective side of the instep shield by said at least one tightening element, each closing flap running in a direction away from a toe area of the upper toward an ankle opening of the upper while being oriented, at most, at a small, acute angle relative to the instep shield; wherein the closing device comprises at least one central tightening lock which forms a means for drawing the closing flaps, as well as the side parts of the shoe upper that are permanently attached to them, toward the instep shield by said at least one tightening element, said at least one tightening element being connected thereto; wherein the at least one central tightening lock is provided on the instep shield; wherein each of the closing flaps is provided with a plurality of guide blocks, each guide block having a guide channel for the at least one tightening element; wherein the instep shield is provided with guides having guide channels for the at least one tightening element; wherein the at least one tightening element connects the closing flaps and passes over the instep shield in a manner that is crossing-free, at least at upper and lower parts of the instep shield, said at least one tightening element running between the guide channels of the closing flaps and the guide channels of the instep shield at both sides thereof; and wherein the guide blocks on each closing flap are joined to each other by the respective closing flap in a manner preventing relative displacement between the guide blocks of the respective closing flap as the respective closing flap is drawn toward the instep shield by the action of said at least one tightening element.

2. Shoe according to claim 1, wherein said at least one tightening element runs in said crossing-free manner over the full length of the instep shield.

3. Shoe according to claim 1, wherein said shoe has a low top upper; and wherein said at least one tightening element produces only one crossing between portions thereof, said crossing being located in a middle area of the instep shield.

4. Shoe according to claim 1, wherein said shoe has a high top upper; and wherein all crossings produced by portions of the at least one tightening element are confined to a middle area of the instep shield.

5. Shoe according to claim 1, wherein said instep shield is formed with intersecting grooves at areas in which portions of said at least one tightening element cross and in which said portions of the at least one tightening element run; and wherein the cross section of the grooves correspond at least approximately to the cross section of said at least one tightening element.

6. Shoe according to claim 5, wherein one of the intersecting grooves is deeper than the other groove intersecting it by approximately the thickness of the tightening element portion which runs therein.

7. Shoe according to claim 6, wherein an instep shield cover is fastened over said instep shield and a flap cover is fastened over each closing flap as a means for retaining said at least one tightening element in the grooves of said instep shield and in channels of the closing flaps, respectively.

8. Shoe according to claim 1, wherein the instep shield and the closing flaps are formed of a single homogeneous injection molded part made of plastic; and wherein the closing flaps automatically occupy an open position in relation to the instep shield in a released state of the injection molded part.

9. Shoe according to claim 8, wherein an opening gap between adjacent sides of the instep shield and closing flaps are closed by sheet-like tabs covering the opening gap.

10. Shoe according to claim 8, wherein an instep shield cover is fastened over said instep shield and a flap cover is fastened over each closing flap as a means for retaining said at least one tightening element in grooves and channels of said instep shield and closing flaps, respectively.

11. Shoe according to claim 10, wherein said instep shield cover and flap covers are formed of a plastic homogeneous injection molded part.

12. Shoe according to claim 11, wherein an opening gap between adjacent sides of the instep shield cover and flap covers are closed by foldable membranes.

13. Shoe according to claim 12, wherein the foldable membranes are in the form of bellows.

14. Shoe according to claim 10, wherein the instep shield cover is locked with the instep shield by locking elements.

15. Shoe according to claim 10, wherein said closing flaps are locked to said flap covers by locking elements.

16. Shoe according to claim 10, wherein the instep shield cover is bonded to said instep shield.

17. Shoe according to claim 10, wherein said flap covers are bonded to the closing flaps.

18. Shoe according to claim 1, wherein said at least one tightening element is alternately looped from one closing flap to the other.

19. Shoe according to claim 1, wherein said at least one tightening element is an elongated flexible member; and wherein said guide channels are arcuate and have inlet and outlet openings, the inlet and outlet openings of opposed and offset guide blocks being arranged relative to one so that the flexible member runs approximately in an S-shaped manner.

20. Shoe according to claim 19, wherein at least two said guide blocks are provided on each closing flap, and at least one guide block is provided in the instep shield, on each side.

21. Shoe according to claim 19, wherein a single central tightening lock is provided and said at least one tightening element is guided out from the central tightening lock, over a first of the closing flaps to the instep shield, then back to the first closing flap, and then to the second of the closing flaps, to the instep shield, then back to the second closing flap, and finally, back to the central tightening lock.

22. Shoe according to claim 21, wherein said friction-resistant material is selected from the group consisting of plastics having a base made of polyamide, polyimide, polyester, and polyurethane, and metals consisting of high-grade steel, titanium, and bronze and alloys thereof.

23. Shoe according to claim 19, wherein the instep shield and closing flaps are formed of a friction-resistant material having a low coefficient of friction.

24. Shoe according to claim 19, wherein the guide channels are lined with a friction-resistant material having a low coefficient of friction.

25. Shoe according to claim 19, wherein the guide channels are formed by sleeves made of a friction-resistant material having a low coefficient of friction.

26. Shoe according to claim 25, wherein said friction-resistant material is selected from the group consisting of plastics having a base made of polyamide, polyimide, polyester, and polyurethane, and metals consisting of high-grade steel, titanium, and bronze and alloys thereof.

27. Shoe according to claim 19, wherein said arcuate guide channels have a radius of curvature of 5 to 15 mm.

28. Shoe according to claim 27, wherein said guide channels have an arcuate length of 100° to 180°.

29. Shoe according to claim 1, wherein said at least one tightening lock forms a means for drawing of the instep shield toward the closing flaps and the side parts of the shoe upper in at least fine steps.

30. Shoe according to claim 1, wherein the instep shield is formed of a springy elastic material, and the flexibility of the instep shield is increased, at least at the lower portion thereof, by a crosswise thinning of the springy elastic material.

31. Shoe according to claim 1, wherein the instep shield and closing flaps are formed of one piece, and have rounded recesses at connecting sites therebetween.

32. Shoe according to claim 1, wherein a slide sheet is fastened on each of the closing flaps and extends under the instep shield.

33. Shoe according to claim 32, wherein the tightening element is sheathed with a plastic sleeve.

34. Shoe according to claim 1, wherein the tightening element is a wire rope.

35. Shoe according to claim 1, wherein at least one tightening band is provided on each of the closing flaps in an area of the metatarsus, and which is permanently connected to at least one of the material of the upper on said side parts of the shoe upper and material of which a sole of the shoe is comprised.

36. Shoe according to claim 35, wherein with tightening bands for one closing flap are connected to a respective tightening band of the other closing flap.

37. Shoe according to claim 35, wherein the tightening bands overly the shoe upper and consist of a transparent or translucent material.

38. Shoe according to claim 35, wherein the tightening bands are permanently connected a closing flap.

39. Shoe according to claim 35, wherein the at least one tightening band provided on each side of the shoe upper are connected together by a homogeneous strap going through the sole.

40. Shoe according to claim 35, wherein at least two tightening bands are provided on at least a lateral side of the shoe.

41. Shoe according to claim 40, wherein the tightening bands on at least the lateral side are at least or approximately parallel to one another.

42. Shoe according to claim 40, wherein the tightening bands on at least the lateral side run angularly relative to one another so as to be at least approximately V-shaped.

43. Shoe according to claim 40, wherein the tightening bands run under an insole of the shoe.

44. Shoe according to claim 40, wherein the at least one tightening band provided on each side of the shoe upper are connected together by a homogeneous strap going through the sole.

45. Shoe according to claim 1, wherein the shoe is provided with a tongue that has a portion which projects into an ankle opening of the upper, and wherein the projecting tongue portion is thickened so as to form a stop wall which is engageable against part of the upper defining said ankle opening.

46. Shoe according to claim 45, wherein the thickened tongue portion is tapered toward an upper end of the tongue.

47. Shoe according to claim 46, wherein the thickened tongue portion tapers toward side edges of the tongue portion.

48. Shoe according to claim 45, wherein the stop wall of the thickened tongue portion at least approximates a right angle with respect to an unthickened tongue part.

49. Shoe according to claim 1, wherein said flexible upper material is selected from the group consisting of natural leather, artificial leather, fiber fabric, and said materials with natural or artificial leather trimmings.

50. Shoe according to claim 1, wherein said small acute angle is in the range of approximately 5° to 15°.

51. Shoe according to claim 1, wherein guide elements for guiding the tightening element are placed on the outside of at least the instep shield and the closing flaps.

52. Shoe according to claim 1, wherein guide elements for guiding the tightening element are disposed on the inside of at least the instep shield and the closing flaps.

53. Shoe according to claim 1, wherein guide elements for guiding the tightening element are disposed in slots formed in at least the instep shield and the closing flaps.

54. Shoe according to claim 1, wherein guide elements for the tightening element are placed on the outside on of the instep shield, and in slots formed in the closing flaps.

55. Shoe according to claim 1, wherein the closing flaps each have at least one elongated slot-shaped groove that extends inwardly into a respective side thereof which faces the instep shield; wherein, on each longitudinal side of the instep shield, at least one guide element having a curved sliding surface for guiding the tightening element is inserted in each of said grooves to receive traction forces occurring in tightening of the tightening element; and wherein the tightening element, in each instance, loops around the curved sliding surface of the guide elements.

56. Shoe according to claim 55, wherein the guide elements consist of a material exhibiting a low friction coefficient and high abrasion,, resistance.

57. Shoe according to claim 55, wherein the guide elements are formed of a flat material that has a thickness that is matched to the thickness of the groove.

58. Shoe according to claim 55, wherein the sliding surface of the guide elements is formed by a guide groove formed in the guide element.

59. Shoe according to claim 55, wherein grooves in the closing flaps and the guide elements are matched in shape to one another in a manner preventing relative rotation therebetween from torsional effects of the tightening element.

60. Shoe according to claim 55, wherein the guide elements are each fastened by at least one pin each, projecting ends of which extend through side walls of the groove of the closing flaps.

61. Shoe according to claim 55, wherein at least one locking projection is provided on flat side walls of each guide element; wherein at least one side wall of the closing flaps is outwardly deflectable in an elastically resilient manner; and wherein the side walls of the flap have a recess or opening in which the locking projection of a respective guide element inserted in the slot-shaped groove engages.

62. Shoe according to claim 55, wherein a correspondingly shaped slot-shaped groove is provided in the closing flaps for each guide element.

63. Shoe according to claim 55, wherein vamps are provided covering an opening gap between the shield and each of the closing flaps.

64. Shoe according to claim 63, wherein each vamp displaceably engages within the slot in the instep-facing side of the respective closing flap.

65. Shoe according to claim 64, wherein at least the guide elements provided in an area of a lower part of are instep shield are recessed so as to be set back from the instep-facing side of the closing flaps in a manner leaving a free section of the groove of the closing flaps in which a part of the respective vamp engages.

66. Shoe according to claim 63; wherein, on the side of the closing flaps facing the instep shield, an elongated groove is provided for both the respective guide elements and vamp.

67. Shoe according to claim 55, wherein the instep shield is provided with a guide element at each side that faces a closing flap, each guide element of the instep shield being located between a pair of guide elements of the respective closing flap in facing relationship to them; and wherein the tightening element forms is looped over each guide element in a crossing-free manner so that that tightening element passes back and forth between a guide element of the closing flap and a facing guide element on the instep shield.

68. Shoe according to claim 67, wherein two guide elements of the insert shield are combined into a structural unit that is fastened to the instep shield.

69. Shoe according to claim 68, wherein the structural unit comprises a center part by which it is fastened to one of the top and bottom sides the instep shield by at least one of a pin and a lock connection.

70. Shoe according to claim 68, wherein the structural unit is bonded to one of top and bottom sides of the instep shield by one of gluing and heat-sealing.

71. Shoe according to claim 68, wherein a center part of the combined guide elements of the structural unit is provided with a recess; and wherein a closing plate is disposed in said recess where it is permanently connected with a pin formed on the instep shield.

72. Shoe according to claim 67, wherein the guide elements are provided in a recess of a bottom side of the instep shield.

73. Shoe according to claim 67, wherein sections of the tightening element intersect in an instep area of the instep shield where they run in closed tubular channels of the instep shield.

74. Shoe according to claim 73, wherein a first of the tubular channels lies deeper within the instep shield than a second of the tubular channels, so that the intersecting tightening element sections do not touch one another at their point of intersection intersection.

75. Shoe according to claim 1, wherein the instep shield is releasably fastened to the closing flaps by a snap connection.

76. Shoe according to claim 1, wherein fastening flanges are formed on outside edges of the closing flaps.

77. Shoe according to claim 76, wherein another fastening flange is formed on a lower tongue neck of the instep shield.

78. Shoe according to claims 1, wherein the instep shield tapers toward a toe-directed end thereof, as viewed from above.

79. Shoe according to claim 78, wherein a toe-directed end of the instep shield is provided with at least one of material weakenings and undulations and grooves which run crosswise to the longitudinal axis of the shoe as a means for increasing flexibility.

80. Shoe according to claim 79, wherein an instep shield cover is provided for covering the instep shield, a front end part of which is made flexible by at least one of crosswise extending reductions of thickness, undulations and grooves.

81. Shoe according to claim 78, wherein a toe-directed end of the closing flaps is provided with at least one of material weakenings and undulations and grooves which run crosswise to the longitudinal axis of the shoe as a means for increasing flexibility.

82. Shoe according to claim 1, wherein the closing flaps and instep shield are connected by flexible connection areas of a hinge- or joint-like construction.

83. Shoe according to claim 82, wherein the connection areas are made in the form of a foldable membrane having folds which run from a connection point to an end edge of the toe area of the instep shield.

84. Shoe according to claim 83, wherein a front end part of the instep shield and closing flaps is made flexible by at least one of crosswise extending reductions of thickness, undulations and grooves which extend across the folds of the membranes.

85. Shoe according to claim 82, wherein an instep shield cover and flap covers are provided for covering the instep shield and a gap between the instep shield and the closing flaps; and wherein the instep shield is a separate and unconnect part from the closing flaps, which comprise separate individual elements.

* * * * *